US008941545B2

(12) United States Patent
Kagaya et al.

(10) Patent No.: US 8,941,545 B2
(45) Date of Patent: Jan. 27, 2015

(54) WINDOWPANE FOR VEHICLE AND ANTENNA

(75) Inventors: Osamu Kagaya, Tokyo (JP); Koji Ikawa, Tokyo (JP); Koutarou Suenaga, Tokyo (JP)

(73) Assignee: Asahi Glass Company, Limited, Tokyo (JP)

( * ) Notice: Subject to any disclaimer, the term of this patent is extended or adjusted under 35 U.S.C. 154(b) by 517 days.

(21) Appl. No.: 13/344,874

(22) Filed: Jan. 6, 2012

(65) Prior Publication Data

US 2012/0154229 A1 Jun. 21, 2012

Related U.S. Application Data

(63) Continuation of application No. PCT/JP2010/061643, filed on Jul. 8, 2010.

(30) Foreign Application Priority Data

Jul. 9, 2009 (JP) ..... 2009-163099

(51) Int. Cl.
*H01Q 1/32* (2006.01)
*H01Q 1/12* (2006.01)
*H01Q 13/10* (2006.01)

(52) U.S. Cl.
CPC ..... *H01Q 1/1271* (2013.01); *H01Q 13/10* (2013.01)
USPC ..... 343/713

(58) Field of Classification Search
CPC ..... H01Q 1/1271; H01Q 1/1285; H01Q 1/32; H01Q 1/3266
USPC ..... 343/713
See application file for complete search history.

(56) References Cited

U.S. PATENT DOCUMENTS

| | | | | |
|---|---|---|---|---|
| 5,012,255 | A | 4/1991 | Becker | |
| 5,355,144 | A | 10/1994 | Walton et al. | |
| 5,898,407 | A | 4/1999 | Paulus et al. | |
| 6,097,345 | A * | 8/2000 | Walton | 343/769 |
| 6,320,276 | B1 | 11/2001 | Sauer | |
| 6,937,198 | B2 | 8/2005 | Iijima et al. | |

(Continued)

FOREIGN PATENT DOCUMENTS

| | | | |
|---|---|---|---|
| EP | 0 720 249 | A2 | 7/1996 |
| JP | 02-082701 | A | 3/1990 |

(Continued)

OTHER PUBLICATIONS

Supplementary European Search Report EP 10797188.9 dated Nov. 12, 2012.

*Primary Examiner* — Hoang V Nguyen
(74) *Attorney, Agent, or Firm* — Foley & Lardner LLP

(57) ABSTRACT

A vehicle window glass has a glass plate, a conductive film laminated on the glass plate and an antenna structured with a feeding structure placed on the conductive film, and is characterized in that the feeding structure has a dielectric and a pair of electrodes, that the conductive film has a slot one end of which makes an upper edge of the conductive film an open end, and is disposed between the glass plate and the dielectric, and that the pair of electrodes are disposed on the opposite side of the side of the conductive film with the dielectric in between so that the slot is sandwiched between the pair of electrodes when the pair of electrodes are projected onto the conductive film, and are capacitively coupled to the conductive film.

15 Claims, 20 Drawing Sheets

(56) References Cited

U.S. PATENT DOCUMENTS

| | | | | |
|---|---|---|---|---|
| 7,119,751 | B2 * | 10/2006 | Li et al. | 343/713 |
| 7,190,316 | B2 * | 3/2007 | Yegin et al. | 343/713 |
| 2006/0202898 | A1 | 9/2006 | Li et al. | |

FOREIGN PATENT DOCUMENTS

| | | | |
|---|---|---|---|
| JP | 03-196704 | A | 8/1991 |
| JP | 03-204202 | A | 9/1991 |
| JP | 06-045817 | A | 2/1994 |
| JP | 09-175166 | A | 7/1997 |
| JP | 11-163625 | A | 6/1999 |
| JP | 2000-059123 | A | 2/2000 |
| JP | 2001-185928 | A | 7/2001 |
| JP | 2005-260659 | A | 9/2005 |
| JP | 2006-151373 | A | 6/2006 |
| JP | 2006-165756 | | 6/2006 |
| JP | 2006-165756 | A | 6/2006 |
| JP | 2006-174050 | A | 6/2006 |
| JP | 2008-135944 | A | 6/2008 |

* cited by examiner

WINDOWPANE FOR VEHICLE AND ANTENNA

TECHNICAL FIELD

The present invention relates to a vehicle window glass having an antenna on a conductive film provided on a glass plate, and an antenna where a slot is formed on the conductive film.

BACKGROUND ART

FIG. 1 is a cross-sectional view of a vehicle laminated glass that is formed with a conductive film 3 and an intermediate film 4 being sandwiched between glass plates 1 and 2. When an antenna conductor 5 for receiving radio waves is formed on the vehicle-interior side of this laminated glass as is conventionally done, there are cases where required reception characteristics cannot sufficiently be obtained on the antenna conductor 5 because radio waves coming from the outside of the vehicle are shielded by the conductive film 3.

To remove such a harmful effect, a window glass is known in which an antenna function is provided by using a conductive film (see, for example, Patent Documents 1, 2, 3 and 4).

PRIOR ART DOCUMENTS

Patent Documents

Patent Document 1: JP-A-H06-45817
Patent Document 2: JP-A-H09-175166
Patent Document 3: JP-A-2000-59123
Patent Document 4: U.S. Pat. No. 5,012,255

SUMMARY OF THE INVENTION

Problem to be Solved by the Invention

Patent Documents 1, 2 and 4 are slot antennas using a slot between the flange of the vehicle body to which the glass plate is fixed and a conductive film. In the case of the slot antenna using the slot between the flange of the vehicle body and the conductive film, the size of the slot depends on the vehicle type, and in particular, to receive the radio waves in the high frequency band, it is difficult to resonate the antenna at a predetermined frequency. Moreover, to receive radio waves in the high frequency band, it is necessary that the positional relationship between the flange and the conductive film can be accurately controlled. However, since there are individual differences among glass plates and the flange is fixed to the vehicle body by a bonding agent, various errors occur in the thickness of the bonding agent, the position of fixing of the glass plate to the flange, and the like. Consequently, there is a problem in that it is difficult to form slots of the same size in mass production.

Moreover, when a slot is provided on the conductive film in addition to the slot of the flange of the vehicle body and the conductive film as in Patent Document 4, there is a problem in that the effect of the conductive film is reduced if the slot is large and when the glass plate is bent by heating, a large heat distribution is caused on the glass plate by the presence or absence of the conductive film and this degrades the forming precision.

Accordingly, an object of the present invention is to provide a vehicle window glass and an antenna using a conductive film which window glass and antenna are capable of resonating the antenna at a predetermined frequency irrespective of the size of the slot between the flange of the vehicle body and the conductive film and require no precision in the placement of the glass plate on the vehicle body flange.

Means for Solving the Problem

To solve the above-mentioned problem, a vehicle window glass according to the present invention is a vehicle window glass comprising: a glass plate; a conductive film laminated on the glass plate; and an antenna structured with a feeding structure placed on the conductive film, wherein the feeding structure has a dielectric and a pair of electrodes, the conductive film has a slot one end of which makes an end portion of the conductive film an open end, and is disposed between the glass plate and the dielectric, and the pair of electrodes are disposed on an opposite side of a side of the conductive film with the dielectric in between so that the slot is sandwiched between the pair of electrodes when the pair of electrodes are projected onto the conductive film, and are capacitively coupled to the conductive film.

Moreover, to solve the above-mentioned problem, an antenna according to the present invention is an antenna comprising: a glass plate; a conductive film laminated on the glass plate; and a feeding structure provided on the conductive film, wherein the feeding structure has a dielectric and a pair of electrodes, that the conductive film has a slot one end of which makes an end portion of the conductive film an open end, and is disposed between the glass plate and the dielectric, and the pair of electrodes are disposed on an opposite side of a side of the conductive film with the dielectric in between so that the slot is sandwiched between the pair of electrodes when the pair of electrodes are projected onto the conductive film, and are capacitively coupled to the conductive film.

Effects of the Invention

According to the present invention, an antenna using a conductive film can be realized that is capable of resonating the antenna at a predetermined frequency irrespective of the size of the slot between the flange of the vehicle body and the conductive film and require no precision in the placement of the glass plate on the vehicle body flange.

MODES FOR CARRYING OUT THE INVENTION

Hereinafter, modes for carrying out the present invention will be described with reference to the drawings. The vehicle window glass according to the present invention may be a windscreen attached to a front part of a vehicle, may be a side window attached to a side part of a vehicle, or may be a rear glass attached to a rear part.

Figure 1:
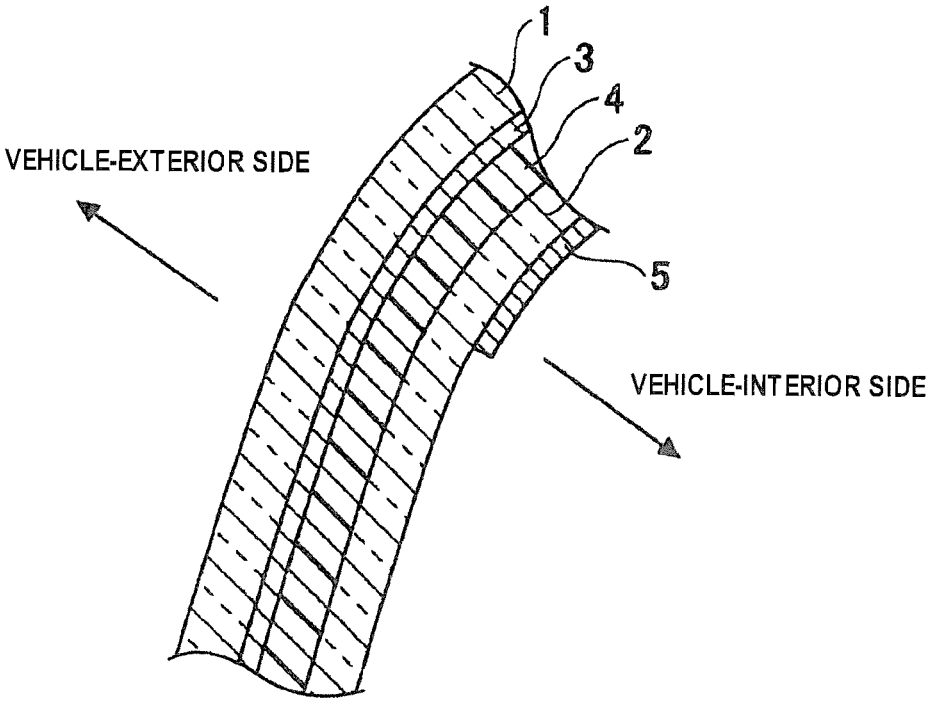
FIG. 1 is a cross-sectional view of the vehicle laminated glass that is formed with the conductive film 3 and the intermediate film 4 being sandwiched between the glass plates 1 and 2.
Figure 2:
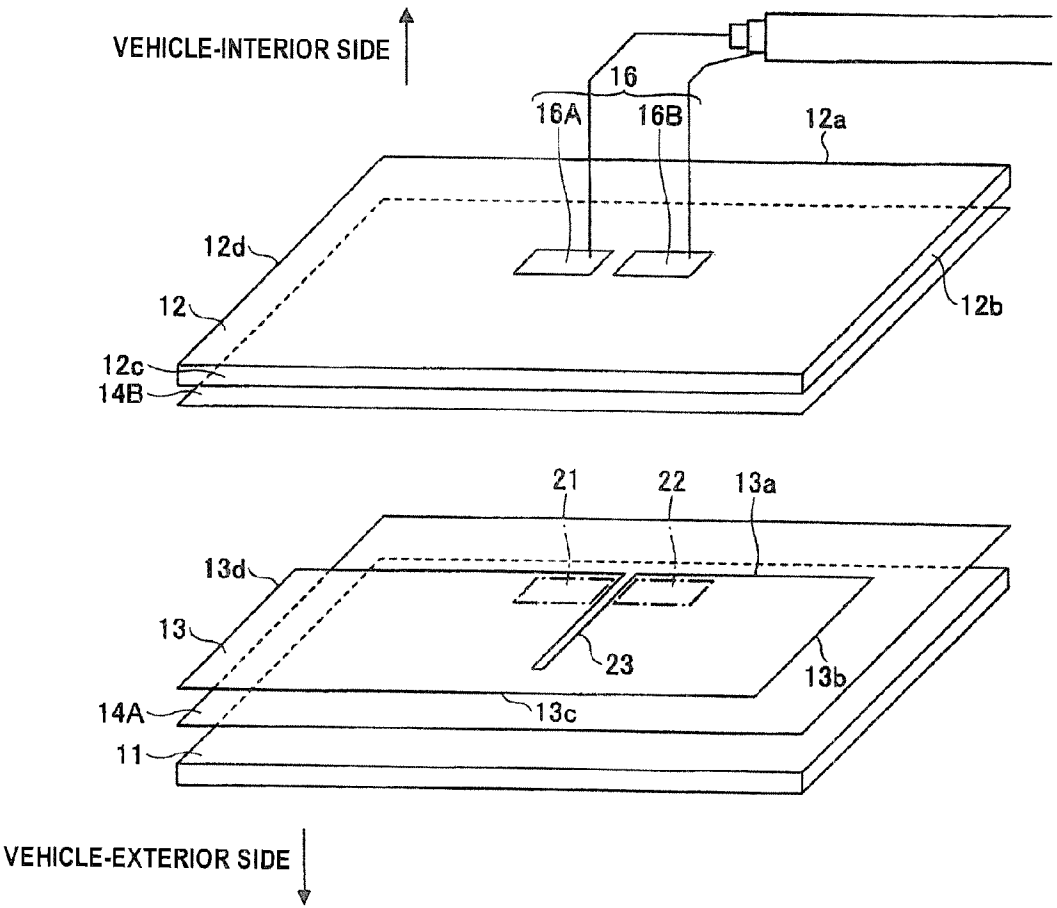
FIG. 2 is an exploded view of a vehicle window glass and an antenna according to the present invention.

FIG. 2 is an exploded view of the vehicle window glass and the antenna according to the present invention. The vehicle window glass shown in FIG. 2 is a laminated glass formed by laminating a glass plate 11 as a first glass plate disposed on the vehicle-exterior side and a glass plate 12 as a second glass plate disposed on the vehicle-interior side. FIG. 2 shows elements of the vehicle window glass and the antenna according to the present invention so as to be separated in the direction of the normal to the plane of the glass plate 11 (or the glass plate 12). The vehicle window glass of FIG. 2 has a lamination structure in which a conductive film 13 is disposed between the glass plate 11 and the glass plate 12, and a pair of electrodes 16 including an electrode 16A and an electrode 16B are disposed on the side opposite to the position of disposition of the conductive film 13 with the glass plate 12 in between. A slot 23 is formed on the conductive film 13. The slot 23 is in contact with the upper edge 13*a* of the conductive film 13. That is, the slot 23 has one end thereof opened at the upper edge 13*a* which is the outer peripheral edge of the conductive film 13. The glass plate 11, the conductive film 13 where the slot 23 is formed, the glass plate 12 and the pair of electrodes 16 are laminated in this order to form an antenna. The conductive film 13 is disposed in the form of a layer between the glass plate 11 and the glass plate 12, and the glass plate 12 is disposed in the form of a layer between the conductive film 13 and the electrodes 16.

As described above, since an antenna can be formed of a conductive film, a slot formed on the conductive film and a pair of electrodes, it can be resonated at a predetermined frequency irrespective of the slot between the vehicle body flange and the conductive film.

Between the glass plate 11 and the conductive film 13, an intermediate film 14A is disposed, and between the conductive film 13 and the glass plate 12, an intermediate film 14B is disposed. The glass plate 11 and the conductive film 13 are joined together by the intermediate film 14A, and the conductive film 13 and the glass plate 12 are joined together by the intermediate film 14B. The intermediate films 14A and 14B are, for example, thermoplastic polyvinyl butyral. To the dielectric constant $\in r$ of the intermediate films 14A and 14B, not less than 2.8 and not more than 3.0 which is a typical dielectric constant of intermediate films of laminated glass can be applied.

The glass plates 11 and 12 are transparent plate-like dielectrics. Either the glass plate 11 or 12 may be semitransparent, or the glass plates 11 and 12 may be both semitransparent. On the conductive film 13 where the slot 23 is formed, a feeding structure including the glass plate 12 as a dielectric and the pair of electrodes 16 is placed to form an antenna.

The conductive film 13 is a conductive heat ray reflecting film capable of reflecting heat rays coming from the outside. The conductive film 13 is transparent or semitransparent. While the conductive film 13 shown in FIG. 2 is a conductive film formed on the surface of polyethylene terephthalate, it may be a conductive film formed on the surface of a glass plate. On the conductive film 13, the slot 23 the open end of which is the upper edge 13*a* of the conductive film 13 is formed.

The electrodes 16 including the electrode 16A and the electrode 16B are disposed on the vehicle-interior side surface of the glass plate 12, that is, the surface opposite to the surface facing the conductive film 13. The electrodes 16 are disposed on the vehicle-interior side surface of the glass plate 12 so as to be exposed. The pair of electrodes 16 are disposed on the surface of the glass plate 12 so as to sandwich the slot 23 in a direction orthogonal to the longitudinal direction of the slot 23 and parallel to the film surface of the conductive film 13 when the pair of electrodes 16 are projected onto the conductive film 13 in the normal direction. That is, the electrode 16A is capacitively coupled to a first coupled part 21 which is a part where the electrode 16A is projected onto the conductive film, through the glass plate and the intermediate film 14B. The electrode 16B is capacitively coupled to a second coupled part 22 which is a part where the electrode 16B is projected onto the conductive film, through the glass plate 12 and the intermediate film 14B. The first coupled part 21 is situated on one side of the conductive film 13 partitioned by the slot 23, and the second coupled part 22 is situated on the other side with the slot 23 in between.

The antenna of the present mode has the lamination structure in which the conductive film 13 is disposed between the glass plate 11 and the glass plate 12, the pair of electrodes 16 including the electrodes 16A and 16B are disposed on the side opposite to the position of disposition of the conductive film 13 with the glass plate 12 in between, and the slot 23 one end of which is an open end is formed on the conductive film 13. The pair of electrodes 16 are provided so that the first coupled part 21 which is the part of projection of the electrode 16A onto the conductive film 13 and the second coupled part 22 which is the part of projection of the electrode 16B onto the conductive film 13 are situated with the slot 23 in between, that the electrode 16A and the first coupled part 21 are separated from each other by a distance where they can be capacitively coupled together and that the electrode 16B and the second coupled part 22 are separated from each other by a distance where they can be capacitively coupled together.

Figure 13:
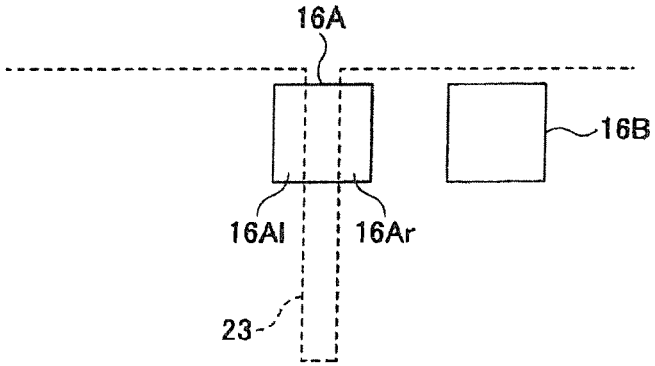
FIG. 13 is a view in which the electrodes 16 are moved rightward with the position of the slot 23 being fixed.

Here, "with the slot 23 in between" includes that one of the pair of electrodes 16 is disposed in a position overlapping the slot 23 as shown in FIG. 13 described later, and it is necessary only that part of the electrode overlapping the slot 23 overlaps the conductive film 13 on the side opposite to the side where the other electrode is situated with respect to the slot 23.

With the antenna of the present mode, by the capacitive coupling of the electrode 16A and the first coupled part 21 and the capacitive coupling of the electrode 16B and the second coupled part 22, an antenna shortening effect is produced, and the length of the slot 23 can be made shorter than the length of the slot required by a typical notch antenna and the like. Consequently, the slot 23 can be made small, and the part where no conductive film is formed can be made small. In consideration of this shortening effect, the slot 23 is formed in a shape and size suitable for receiving the radio waves in the frequency band that the antenna is to receive. The slot 23, that is, the shape and size of the slot 23 are set so as to satisfy the required value of the antenna gain necessary for receiving the radio waves in the frequency band that the antenna is to receive.

For example, when the frequency band that the antenna is to receive is the terrestrial digital television broadcast band of 470 to 710 MHz, the slot 23 is formed so as to be suitable for receiving the radio waves of the terrestrial digital television broadcast band of 470 to 710 MHz.

Figure 10:
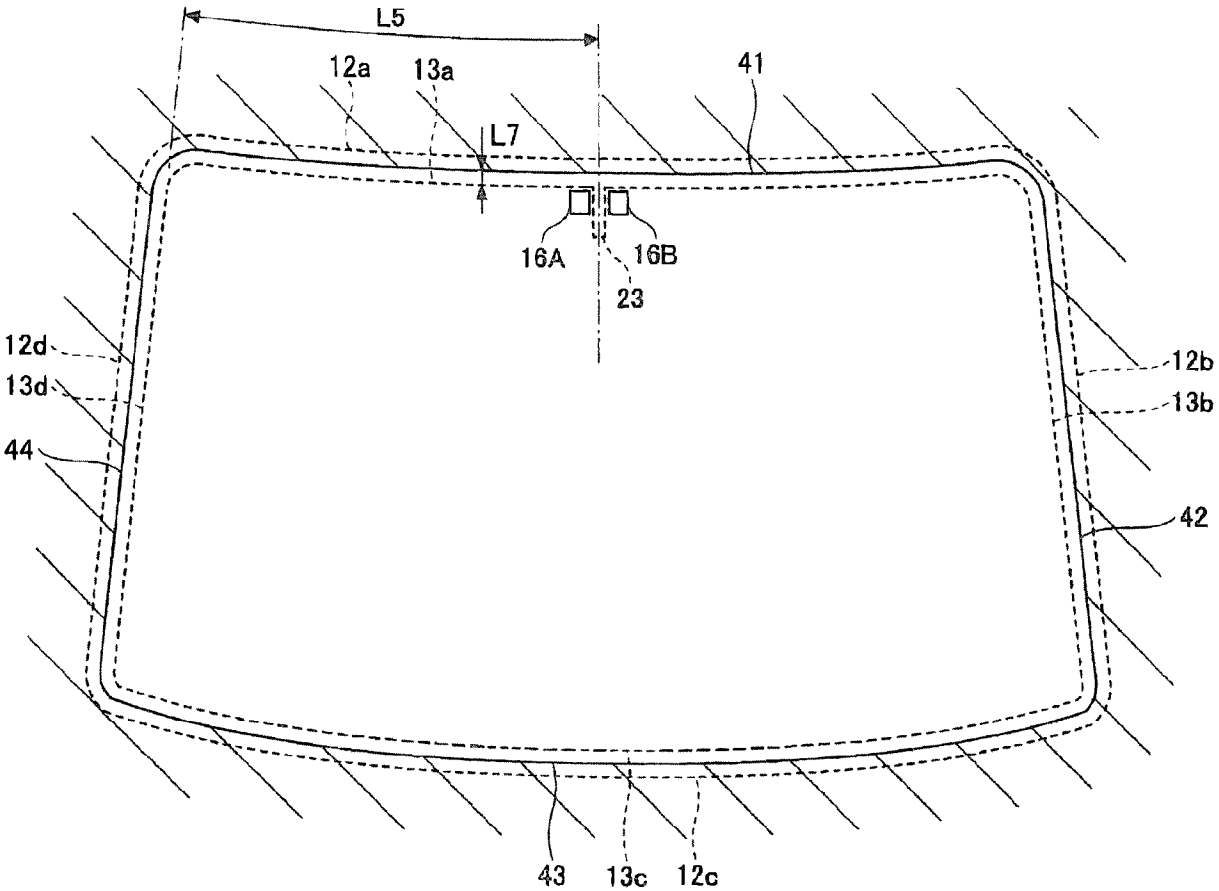
FIG. 10 is a front view (viewed from the vehicle-interior side) of a laminated glass attached to a vehicle body opening.

The position of antenna disposition on the glass is not specifically limited as long as it is suitable for receiving the radio waves in the frequency band that the antenna is to receive. For example, the antenna of the present mode is disposed in the vicinity of a vehicle body open end which is a part to which the vehicle window glass is attached. Disposing the antenna in the vicinity of a roof side vehicle body open end 41 as shown in FIG. 10 is suitable in respect of antenna gain improvement. Moreover, the antenna may be disposed in a position shifted rightward or leftward from the position shown in FIG. 10 so as to approach a pillar side vehicle body open end 42 or 44. Moreover, it may be disposed in the vicinity of a chassis side vehicle body open end 43. In the case of FIG. 10, the longitudinal direction of the slot 23 coincides with the direction orthogonal to the side of the vehicle body open end 41 or 43.

In FIG. 2, the antenna of the present mode is a dipolar type antenna having the lamination structure in which the conductive film 13 is disposed between the glass plate 11 and the glass plate 12, and including: the signal line side electrode 16A; the ground line side electrode 16B; the first coupled part 21 capacitively coupled to the electrode 16A through the glass plate 12; the second coupled part 22 capacitively coupled to the electrode 16B through the glass plate 12; and the slot 23 sandwiched between the first coupled part 21 and the second coupled part 22. The electrode 16A may be the ground line side electrode while the electrode 16B may be the signal line side electrode. The electrode 16A is connected in such a way that electrical continuity can be established with the signal line connected to a signal processor (for example, an amplifier) mounted on the vehicle body side. The electrode 16B is connected so that electrical continuity can be established with the ground line connected to a ground part on the vehicle body side. Examples of the ground part on the vehicle side include the body earth and the ground of the signal processor to which the signal line connected to the electrode 16A is connected.

The reception signal of the radio wave received by the antenna is transmitted to the signal processor mounted on the vehicle, through a conductive member connected to the pair of electrodes 16 so that electrical continuity can be established. As this conductive member, a feeder line such as an AV line or a coaxial cable is used.

When a coaxial cable is used as the feeder line for feeding to the antenna through the electrodes 16A and 16B, the internal conductor of the coaxial cable is electrically connected to the electrode 16A, and the external conductor of the coaxial cable is connected to the electrode 16B. Moreover, a structure may be adopted in which a connector for electrically connecting a conductive member such as a lead wire connected to the signal processor and the electrodes 16A and 16B are mounted on the electrodes 16A and 16B. Such a connector facilitates the attachment of the internal conductor of the coaxial cable to the electrode 16A and facilitates the attachment of the external conductor of the coaxial cable to the electrode 16B. Further, a structure may be adopted in which a protrusion-form conductive member is placed on the electrodes 16A and 16B and the protrusion-form conductive member is in contact and engaged with the flange of the vehicle to which the glass plate 12 is attached.

Moreover, the electrodes 16A and 16B are formed by printing a paste containing a conductive metal such as silver paste onto the vehicle-interior side surface of the glass plate 12 and baking it. However, the formation method is not limited thereto; a linear member or a foil-form member made of a conductive material such as copper may be formed on the vehicle-interior side surface of the glass plate 12 or may be pasted to the glass plate 12 with a bonding agent or the like.

The shape of the electrodes 16A and 16B and the distance between the electrodes are determined in consideration of the shape of the above-mentioned conductive member or the surfaces where the connector is mounted and the distance between the connector-mounted surfaces. For example, a four-angled shape such as a square, a substantial square, a rectangle and a substantial rectangle, or a polygon are preferable in terms of mounting. The shape may be a circular shape such as a circle, a substantial circle, an ellipse and a substantial ellipse.

Figure 8:
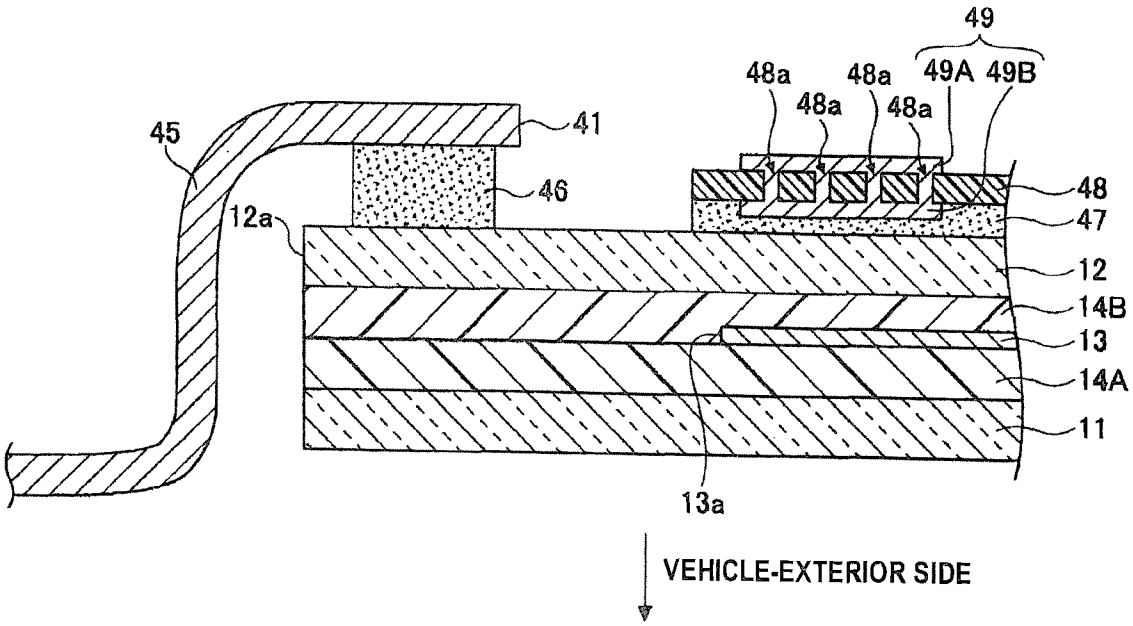
FIG. 8 is a cross-sectional view of a laminated glass where a dielectric substrate 48 is attached to the glass plate 12.

Moreover, as shown in FIG. 8, a dielectric substrate 48 where electrodes 49 corresponding to the electrodes 16 are formed may be attached to the vehicle-interior side of the glass plate 12. FIG. 8 is a cross-sectional view of a laminated glass where the dielectric substrate 48 is attached to the glass plate 12. While a glass epoxy substrate with FR4 as the base material is cited as an example of the dielectric substrate 48, if the impedance is adjusted, a substrate of a different material may be used. The dielectric substrate 48 is pasted to the surface of the glass plate 12, for example, with an acrylic foam tape 47. The electrodes 49 include an upper electrode 49A formed on the upper surface of the dielectric substrate 48 and a lower electrode 49B formed on the lower surface of the dielectric substrate 48. The upper electrode 49A and the lower electrode 49B are electrically continuous with each other through a plurality of through holes 48*a*. The electrodes 49 are provided two in number on the dielectric substrate 48, and form the electrodes 16 corresponding to the electrodes 16A and 16B shown in FIG. 2., etc. According to the feeding structure shown in FIG. 8, by previously attaching the above-mentioned connector to the upper electrode 49A, the connector can be mounted on the glass plate only by pasting the dielectric substrate 48 to the glass plate 12, so that work can be simplified.

As shown in FIG. 8, the laminated glass is, when attached to the vehicle body open end 41 or the like, attached to the flange portion of a vehicle body frame 45 with a bonding agent 46 (or gasket).

Figure 3A:
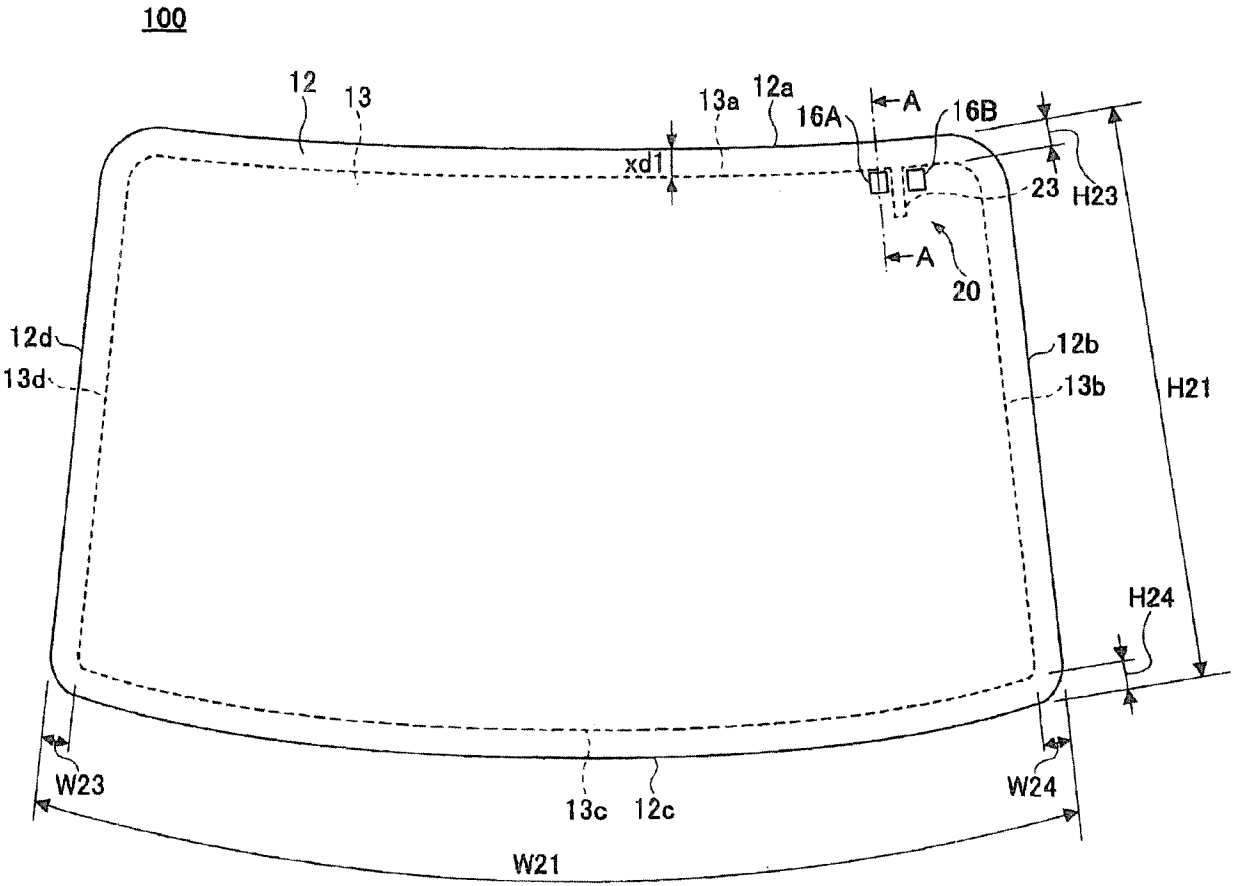
FIG. 3A is a front view of a vehicle window glass 100 as a first embodiment of the present invention.
Figure 3B:
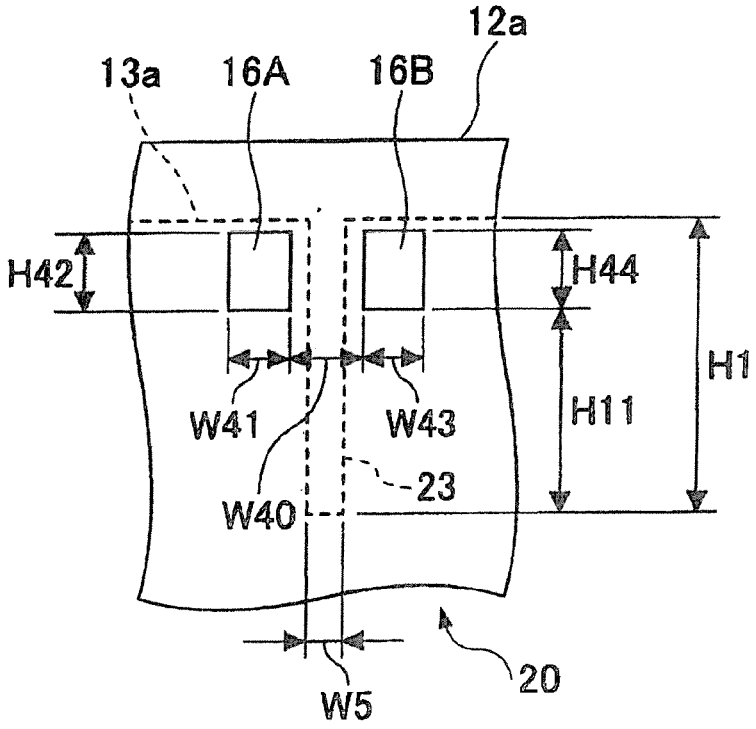
FIG. 3B is an enlarged view of an antenna 20.

FIG. 3A is a front view of a vehicle window glass 100 as a first embodiment of the present invention. FIG. 3A is a view when the surface of the glass plate 12 disposed on the vehicle-interior side is viewed from the vehicle-interior side so as to be faced. FIG. 3A is a general view of the vehicle window glass 100. In the case of FIG. 3A, an antenna 20 is disposed on the upper right side of the vehicle window glass 100. FIG. 3B is an enlarged view of the part where the antenna 20 is disposed.

The edges (13*a* to 13*d*) of the conductive film 13 are offset inward by a distance xd1 from the edges (12*a* to 12*d*) of the glass plate 12. By providing such an offset, the conductive film 13 can be prevented from corroding due to the intrusion of water from the junction surface of the glass plates 11 and 12, or the like.

Figure 3C:
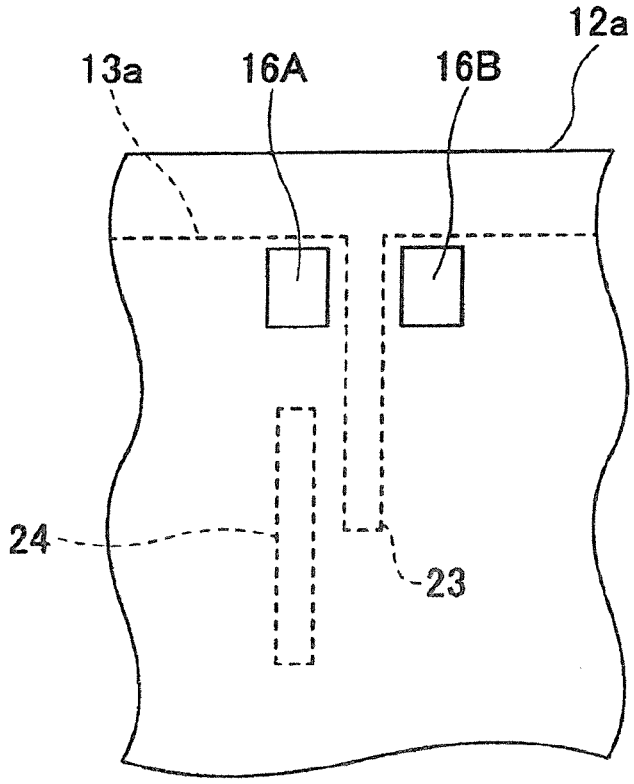
FIG. 3C shows an example in which an independent slot 24 is added.

Moreover, as shown in FIG. 3C, an independent slot 24 that is out of contact with the slot 23 may be formed in the vicinity of the slot 23 so as to be closed within the conductive film 13 without being in contact with the outer peripheral edge of the conductive film 13. Moreover, the independent slot may be formed so that one end thereof is an open end like the slot 23. By providing the independent slot 24, the bandwidth of the antenna 20 can be made wide compared with when the independent slot 24 is not provided.

FIGS. 4A to 4F are cross-sectional views of the vehicle window glass 100 taken along A-A shown in FIG. 3A. FIGS. 4A to 4F show variations of the lamination structure of the vehicle window glass and the notch antenna according to the present invention. FIG. 4A to 4F show modes that have a lamination structure of the glass plate 11 and the conductive film 13 disposed between the glass plate 11 and a dielectric (that is, the glass plate 12 or a dielectric substrate 32) and in which the pair of electrodes 16 are disposed on the opposite side of the conductive film 13 with the dielectric in between. The conductive film 13 is in contact with the bonding layer between the glass plate and the dielectric.

Figure 4A:
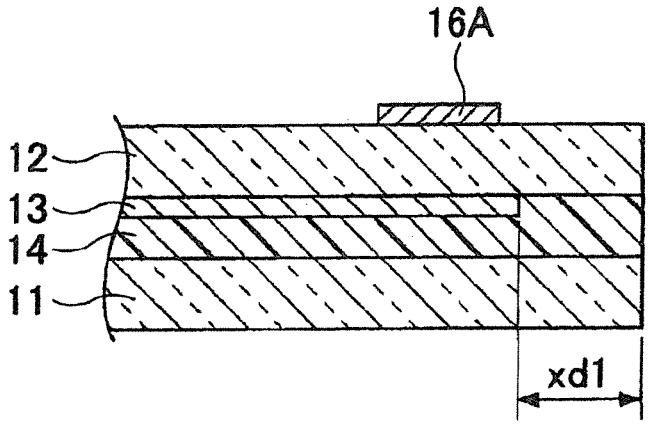
FIG. 4A shows a mode in which a glass plate 12 is coated with a conductive film 13.
Figure 4B:
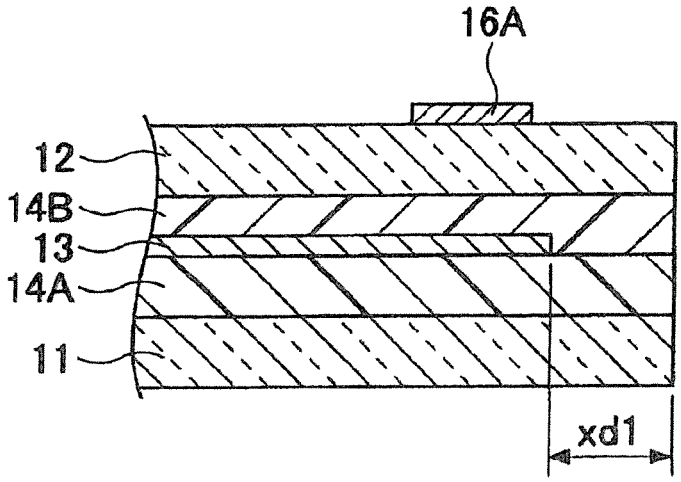
FIG. 4B shows a mode in which the conductive film 13 is sandwiched between an intermediate film 14A and an intermediate film 14B.
Figure 4C:
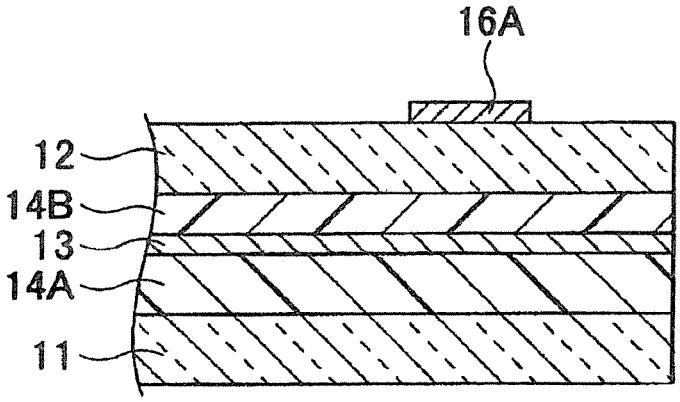
FIG. 4C shows a mode in which in the mode of FIG. 4B, the conductive film 13 is not offset with respect to the glass plate 12.
Figure 4D:
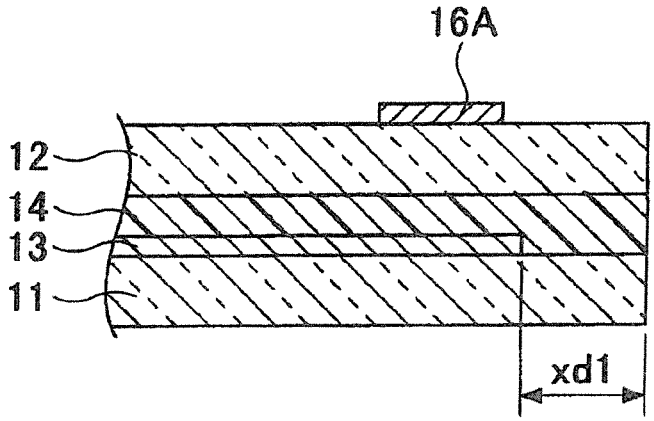
FIG. 4D shows a mode in which the glass plate 11 is coated with the conductive film 13.

In the cases of FIGS. 4A to 4D, the conductive film 13 and the intermediate film 14 (or the intermediate films 14A and 14B) are disposed between the glass plate 11 and the glass plate 12. FIG. 4A shows a mode in which the glass plate 12 is coated with the conductive film 13 by evaporating the conductive film 13 onto the facing surface of the glass plate 12 facing the glass plate 11. FIG. 4B shows a mode in which the conductive film 13 of a film form is sandwiched between the intermediate film 14A in contact with the facing surface of the glass plate 11 facing the glass plate 12 and the intermediate film 14B in contact with the facing surface of the glass plate 12 facing the glass plate 11. The film-form conductive film 13 may be of a mode in which a film is coated with the conductive film 13 by evaporating the conductive film 13 onto the film. FIG. 4C shows a mode in which in the mode of FIG. 4B, the conductive film 13 is not offset with respect to the glass plate 12. FIG. 4D shows a mode in which the glass plate 11 is coated with the conductive film 13 by evaporating the conductive film 13 onto the facing surface of the window glass 11 facing the window glass 12.

Figure 4E:
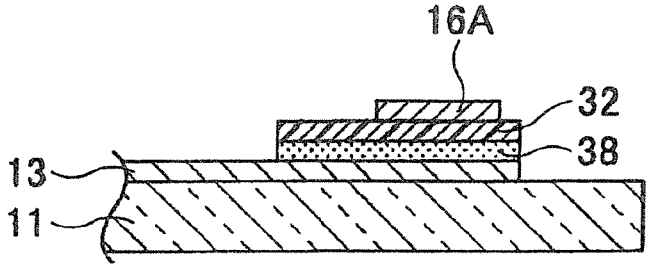
FIG. 4E shows a mode in which the glass plate 11 is coated with the conductive film 13 that is between the glass plate 11 and a dielectric substrate 32.
Figure 4F:
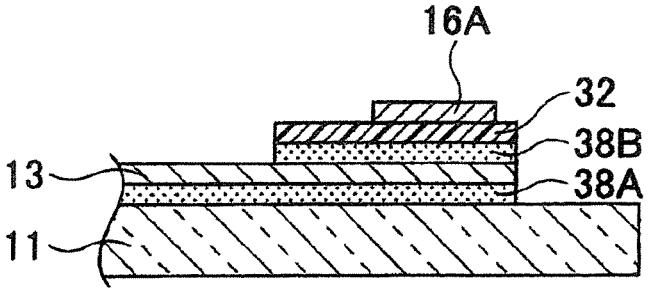
FIG. 4F shows a mode in which the conductive film 13 between the glass plate 11 and the dielectric substrate 32 is bonded to the glass plate 11 with a bonding agent 38A.

Moreover, as shown in FIGS. 4E and 4F, the vehicle window glass according to the present invention is not necessarily laminated glass. In the cases of FIGS. 4E and 4F, the conductive film 13 is disposed between the glass plate 11 and the dielectric substrate 32. FIG. 4E shows a mode in which the glass plate 11 is coated with the conductive film 13 by evaporating the conductive film 13 onto the facing surface of the glass plate 11 facing the dielectric substrate 32. The conductive film 13 and the dielectric substrate 32 are bonded together with a bonding agent 38. FIG. 4F shows a mode in which the conductive film 13 is bonded to the facing surface of the glass plate 11 facing the dielectric substrate 32 with a bonding agent 38A. The conductive film 13 and the dielectric substrate are bonded together with a bonding agent 38B. The dielectric substrate 32 is a resin substrate made of a resin, and is provided with a pair of electrodes. The resin substrate may be a printed circuit board where a pair of electrodes are printed.

Figure 5A:
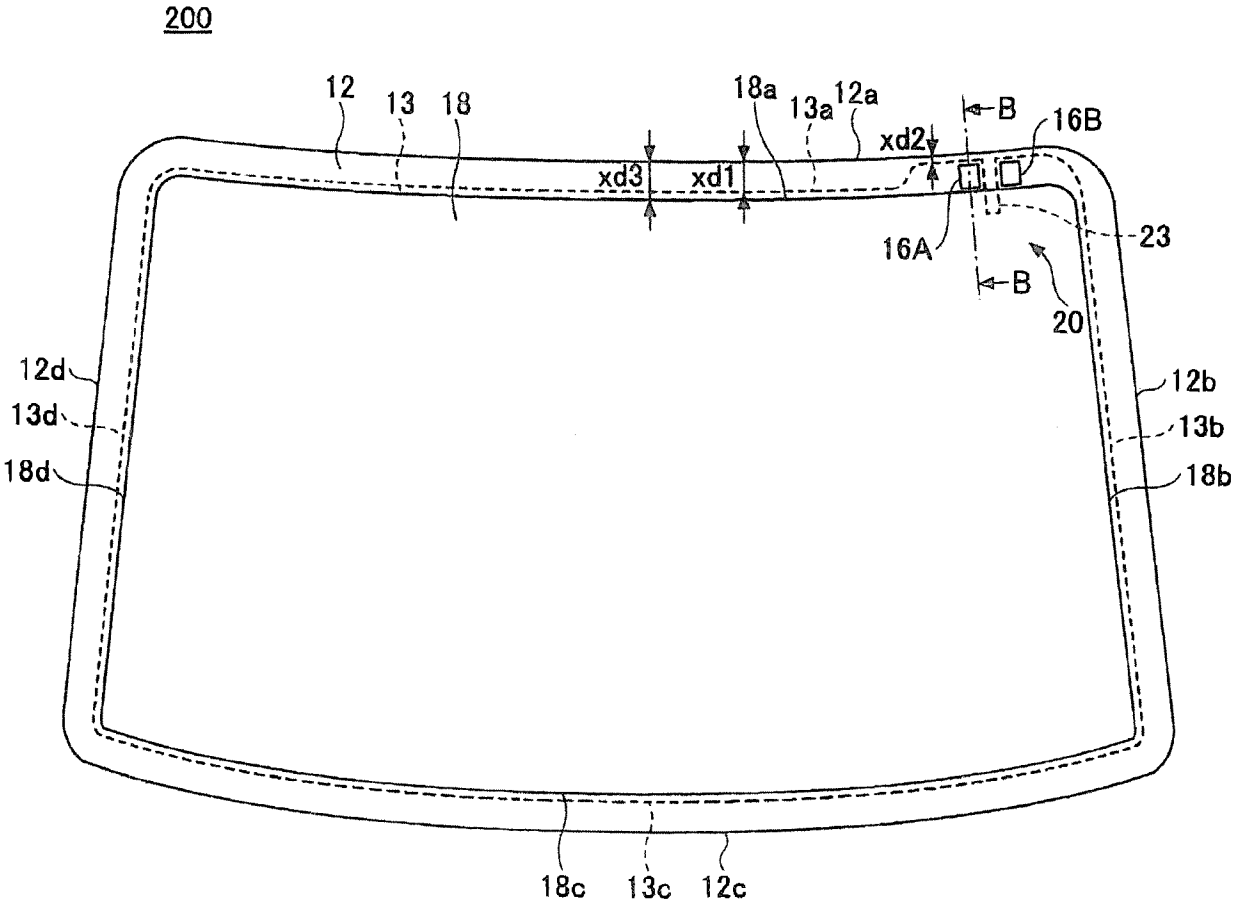
FIG. 5A is a front view of a vehicle window glass 200 as a second embodiment of the present invention.

FIG. 5A is a front view and a B-B cross-sectional view of a vehicle window glass 200 as a second embodiment of the present invention. FIG. 5A is a front view when the surface of the glass plate 12 disposed on the vehicle-interior side is viewed from the vehicle-interior side so as to be faced. Descriptions of the parts similar to those of FIG. 3A are omitted or simplified.

As shown in FIG. 5A, in order to make the electrodes 16A and 16B invisible from the vehicle-exterior side, a shielding film 18 formed on the glass plate surface may be provided between the pair of electrode 16 and the glass plate 11 (on the back side of the plane of the figure in FIG. 5A). As the shielding film 18, a ceramics which is a burned member such as a black ceramics film is cited. In this case, when viewed from the vehicle-exterior side of the window glass, the parts of the electrodes 16A and 16B provided on the shielding film 18 are invisible from the outside of the vehicle because of the shielding film 18, which results in a window glass with an excellent design.

Figure 5B:
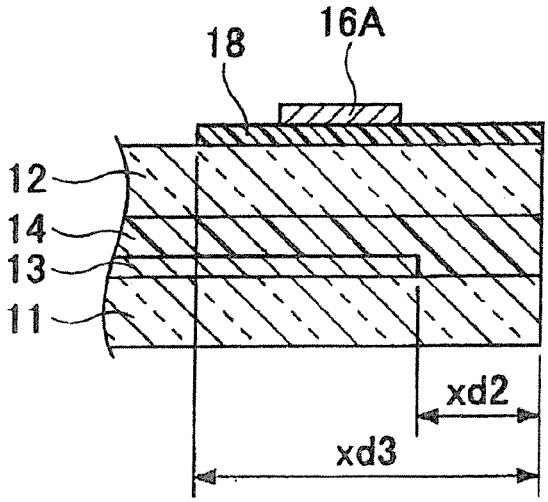
FIG. 5B shows a mode in which a shielding film 18 is disposed between the glass plate 12 and the electrodes 16.
Figure 5C:
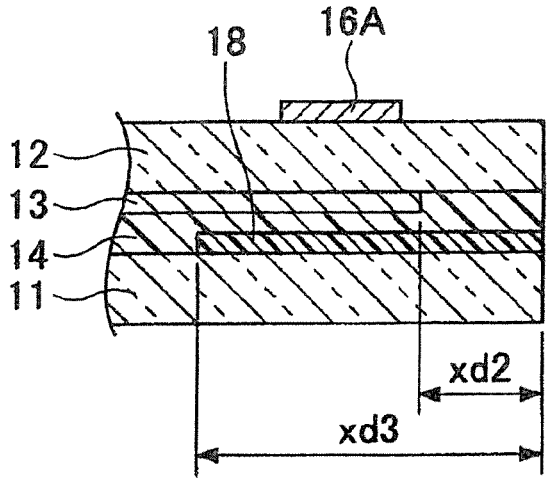
FIG. 5C shows a mode in which the shielding film 18 is disposed between the glass plate 11 and the conductive film 13.

FIGS. 5B and 5C are cross-sectional views of the vehicle window glass 100 taken along B-B shown in FIG. 5A. FIGS. 5B and 5C show variations of the lamination structure of the vehicle window glass and the antenna according to the present invention. FIGS. 5B and 5C show modes that have a lamination structure of the glass plate 11 and the conductive film 13 disposed between the glass plate 11 and a dielectric (that is, the glass plate 12) and in which the pair of electrodes 16 are disposed on the opposite side of the conductive film 13 with the dielectric in between.

In the cases of FIGS. 5B and 5C, the conductive film 13 and the intermediate film 14 are disposed between the glass plate 11 and the glass plate 12. FIG. 5B shows a mode in which the glass plate 11 is coated with the conductive film 13 by evaporating the conductive film 13 onto the facing surface of the glass plate 11 facing the glass plate 12. The shielding film 18 formed on the glass plate 12 is disposed between the glass plate 12 and the electrodes 16. FIG. 5C shows a mode in which the glass plate 12 is coated with the conductive film 13 by evaporating the conductive film 13 onto the facing surface of the glass plate 12 facing the glass plate 11. The shielding film 18 formed on the glass plate 11 is disposed between the glass plate 11 and the conductive film 13.

The shielding film 18 is formed in a region a distance xd3 inward from the outer edge of the glass plate 12. By making the distance xd1 (or xd2) between the outer edge of the glass plate 12 and the conductive film 13 shorter than the distance xd3, the outer peripheral edge of the conductive film 13 can be hidden by the shielding film 18, so that the outer peripheral edge of the conductive film is made inconspicuous to improve the design. Moreover, the heat ray can be shielded by the conductive film 13 and the shielding film 18 without any gap.

The angle of attachment of the window glass to the vehicle is, preferably, 15 to 90 degrees, in particular, 30 to 90 degrees with respect to the horizontal plane (level surface).

EXAMPLE 1

An experiment was performed with the assumption that a square glass substrate that was 300 mm in height and width and 3.1 mm in thickness was a window glass. On one surface that was assumed as the vehicle-exterior side surface of this glass substrate, a pair of electrodes separated from each other by an electrode-to-electrode distance of 5 mm were formed, and on the other surface assumed as the vehicle-interior side surface, a copper foil having an antenna slot formed thereon was formed with the assumption that the foil was the conductive film. As for the size of the electrodes, they were squares that were 15 mm in height and width. The size of the copper foil was 250 mm in height and 300 mm in width. The offset distance from the edge of the glass substrate assumed as the roof side edge to the edge of the copper foil was set to 50 mm. A slot was formed on the copper foil so that one end of the antenna slot was opened at the roof side edge of the copper foil. It was assumed that there was neither vehicle body nor defogger.

With respect to the antenna actually produced in this manner and an antenna having the same size as this obtained in a numerical calculation, the return loss characteristic (reflection characteristic) S11 was measured every 5 Hz at frequencies of 100 to 1100 MHz. Moreover, measurement was performed for the notch antenna of each of the modes of FIGS. 3B and 3C. In the case of the numerical calculation, the numerical calculation was performed by an electromagnetic simulation based on the FDTD (Finite-Difference Time-Domain) method, and the return loss characteristic (reflection coefficient) S11 was calculated. The closer to zero S11 is, the larger the return loss is and the lower the antenna gain is, and the higher the negative value of S11 is, the smaller the return loss is and the higher the antenna loss is.

As for the dimensions at the time of the measurement of S11 in the mode of FIG. 3B, the length in the longitudinal direction of the slot 23 was 83 mm, and the width of the slot 23 was 3 mm.

As for the dimensions at the time of the measurement of S11 in the mode of FIG. 3C, the length in the longitudinal direction and the width of the slot 23 were the same as those in the case of FIG. 3B. The length in the longitudinal direction of the independent slot 24 parallel to the longitudinal direction of the slot 23 was 165 mm, and the width of the independent slot 24 was 3 mm. The direction of separation between the slot 23 and the independent slot 24 in a direction orthogonal to the longitudinal direction was 10 mm. The shortest distance between the roof side edge of the copper foil and the independent slot 24 was 41.5 mm.

Figure 6A:
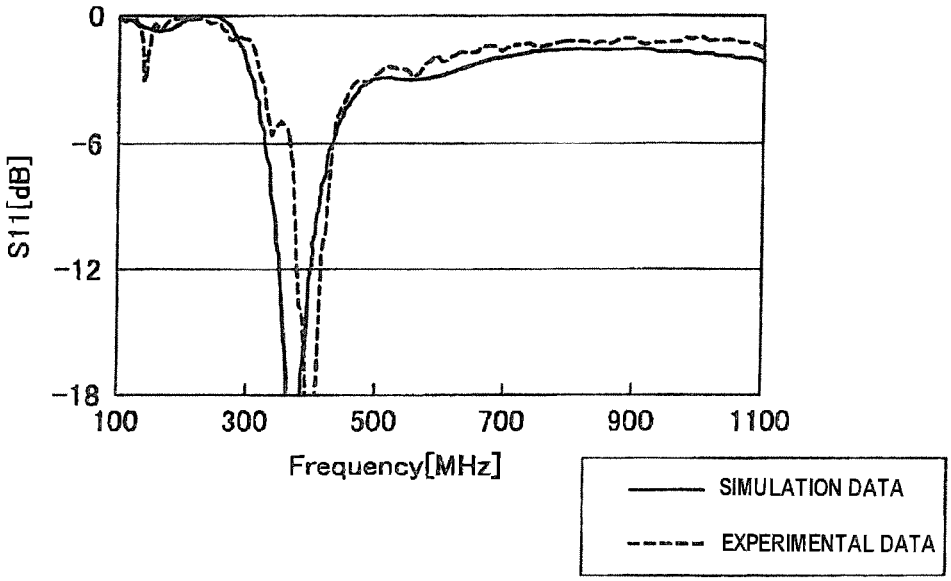
FIG. 6A shows the simulation results and experimental results of S11 with respect to the embodiment (FIG. 3B) of the vehicle window glass and the antenna according to the present invention.
Figure 6B:
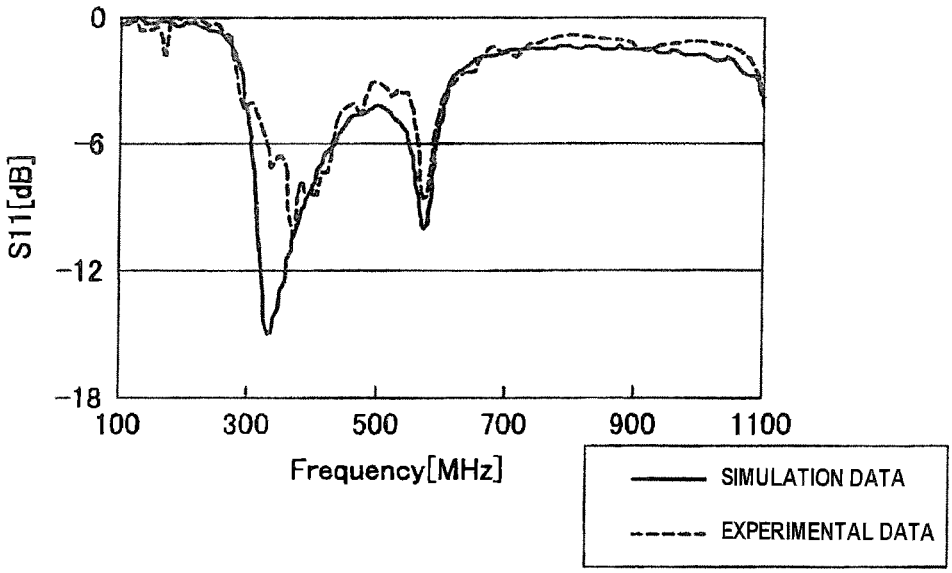
FIG. 6B shows the simulation results and experimental results of S11 with respect to the embodiment (FIG. 3C) of the vehicle window glass and the antenna according to the present invention.

FIGS. 6A and 6B show the simulation result and the experimental result of S11 of FIGS. 3B and 3C. FIG. 6A shows the results in the case of FIG. 3B, and FIG. 6B shows the results in the case of FIG. 3C. In FIGS. 6A and 6B, the solid line represents the calculation values in the simulation, and the dotted line represents experimental values.

As shown in FIG. 6A, it is apparent that the antenna of FIG. 3B has a resonance point in the vicinity of 350 to 400 MHz and that the conductive film functions as an antenna.

Moreover, as shown in FIG. 6B, since two resonance points are generated in the vicinity of 300 to 350 MHz and in the vicinity of 550 to 600 MHz by providing the independent slot 24, the bandwidth can be made wide compared with when there is no independent slot.

Figure 7:
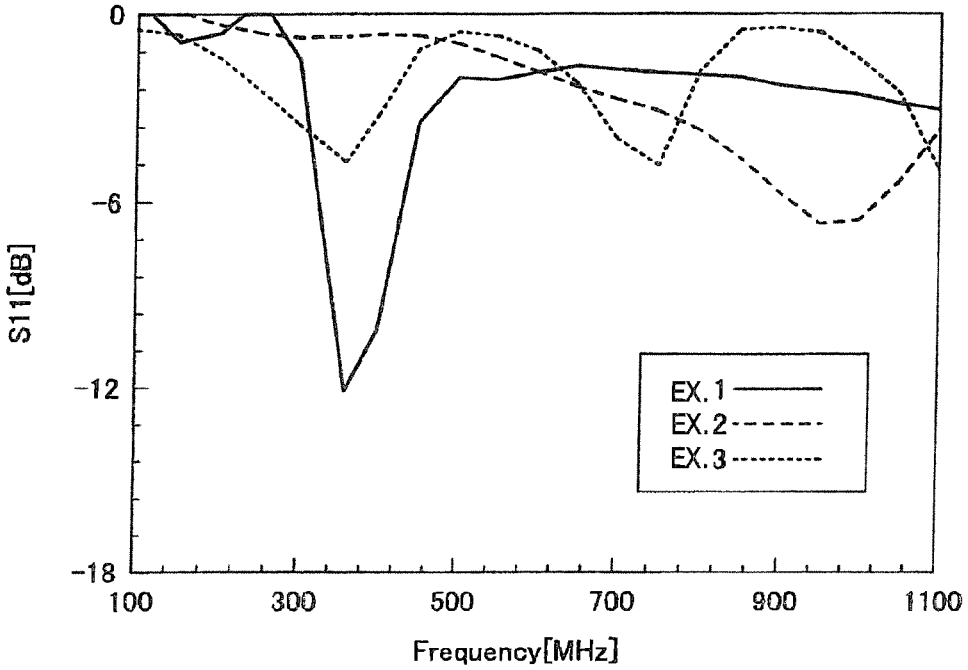
FIG. 7 shows the simulation results of S11 with respect to three kinds of antennas for explaining effects of Example 1.

FIG. 7 shows the results of comparison among the antenna of FIG. 3B (ex. 1), a notch antenna directly fed to the slot without any capacitive coupling in a conductive film having a slot of the same shape as that of FIG. 3B (ex. 2) and a notch antenna in which the length of the slot is adjusted to 275 mm so that the antenna resonates in the vicinity of 350 to 400 MHz in the notch antenna directly fed to the slot without any capacitive coupling (ex. 3). These are simulation results. From these results, in the notch antenna of ex. 2, even if a slot of the same shape as that of the antenna of FIG. 3B (ex. 1) is provided, since the length of the slot is short, the antenna resonates on the high frequency side. When the length of the slot is increased to shift the resonance frequency toward the low-frequency side, a length of 275 mm is required like ex. 3. Consequently, it is found that the slot of the antenna of FIG. 3B may be short. Moreover, by structuring the feeding structure by capacitive coupling, the return loss can be made small at the resonance point compared with the notch antenna directly fed to the slot without any capacitive coupling, so that the antenna gain can be improved.

As described above, according to the above-described structure, an antenna can be structured that uses a conductive film without using a slot between the vehicle body flange and the conductive film. Consequently, since the vehicle body flange is not used, no precision in the placement of the glass plate on the vehicle body flange is required. In addition, the length of the slot can be made short compared with when a slot provided on the conductive film is directly fed, and the region where there is no conductive film can be made small. Moreover, since it is unnecessary to form a hole in the glass plate and it is also unnecessary to provide a conductor for feeding that detours around the outside of the outer peripheral edge of the glass plate, an antenna using a conductive film can be realized with a simple structure.

EXAMPLE 2

In Example 2, effects of bandwidth widening of the antenna of the present invention by adding the independent slot will be described.

Figure 9:
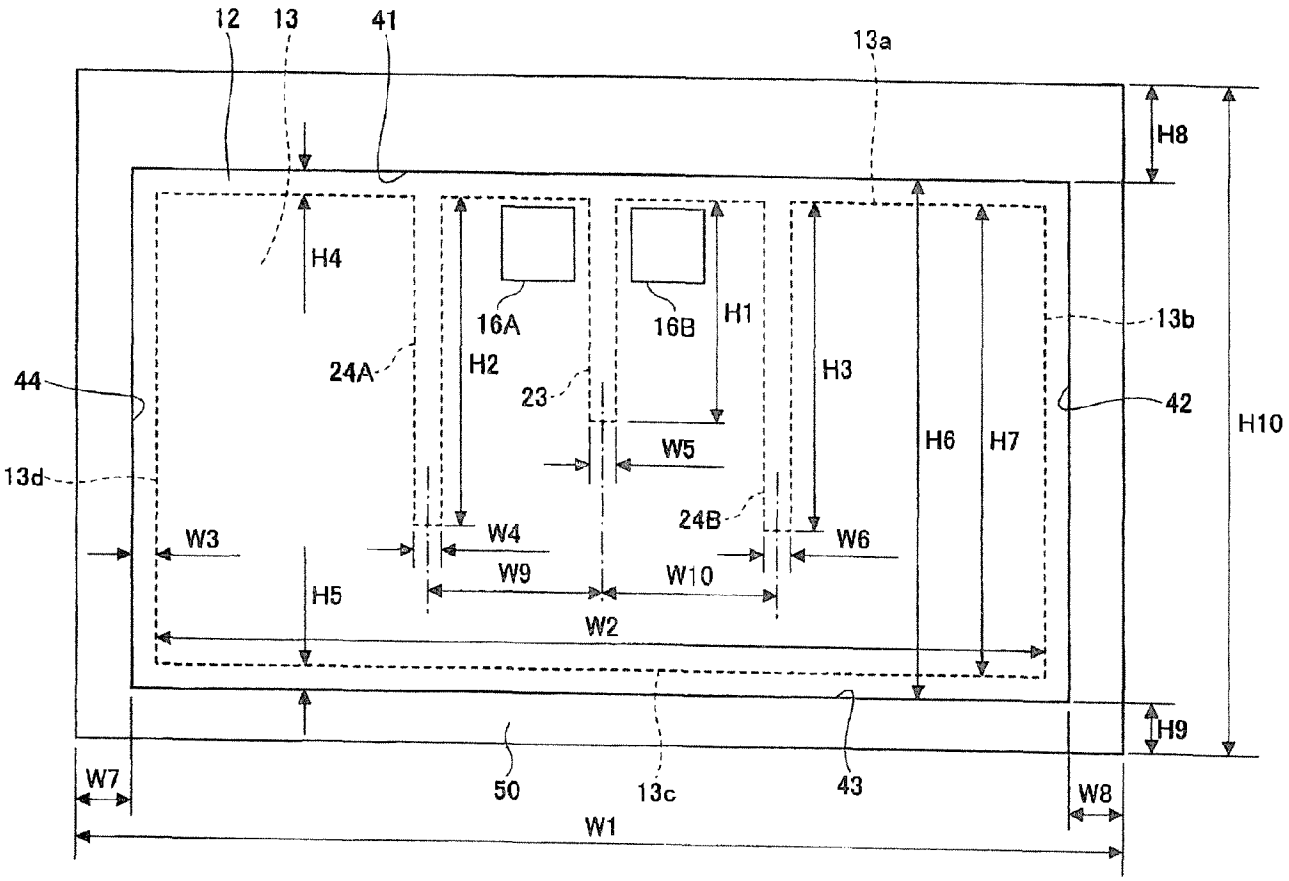
FIG. 9 is a conceptual view of an antenna where the independent slot 24 (24A and 24B) is added to the antenna of the mode of FIG. 3B.

FIG. 9 is a typical view of an antenna where the independent slot 24 (24A and 24B) is added to the antenna of the mode of FIG. 3B. The independent slots 24A and 24B are non-feeding slots formed with one ends thereof as open ends. The open ends of the independent slots 24A and 24B are in contact with the upper edge 13*a* of the conductive film 13 with which the open end of the slot 23 is in contact. The independent slot 24A is formed so that the electrode 16A is situated between it and the slot 23, and the independent slot 24B is formed so that the electrode 16B is situated between it and the slot 23.

In Example 2, assuming the antenna of the mode of FIG. 9 in which the conductive film 13 was provided in an inner layer of the laminated glass, a numerical calculation based on the FDTD method was performed every 0.6 MHz at frequencies of 200 to 500 MHz. Moreover, assuming that the size of the laminated glass was changed, the numerical calculation was performed for three glass sizes among which W1, W2, H7 and H10 were different from one another. In this numerical calculation, modeling was performed while a vehicle body frame which was the part to which the laminated glass where the antenna was formed was attached was regarded as a conductor 50, and the boundary condition of the periphery of the glass was infinite.

The layer structure of FIG. 9 was that of the mode of FIG. 4B. It was assumed that the conductor 50 was formed on the same layer as the electrodes 16A and 16B. The dimensions (unit: mm) and constants of the parts in FIG. 3B and FIG. 9 were as follows:

Example 2-1

First Glass Size

H1: 70
H2, H3: 170
H4, H5: 10
H6: 376
H7: 356
H8: 90
H9: 40
H10: 506
H11: 50
W1: 960
W2: 880
W3: 10
W4, W5, W6: 3
W7, W8: 40
W9, W10: 100
W40: 5
W41, H42, W43, H44: 20

Example 2-2

Second Glass Size (Only Dimensions Changed from Those of Example 2-1 are Shown)

H7: 470
H10: 620
W1: 1200
W2: 1100

Example 2-3

Third Glass Size (Only Dimensions Changed from Those of Example 2-1 are Shown)

H7: 604
H10: 734
W1: 1440
W2: 1360

Dimensions and Constants Common to Examples 2-1, 2-2 and 2-3

Thickness of the glass plates 11 and 12: 2.0
Dielectric constant of the glass plates 11 and 12: 7.0
Thickness of the intermediate films 14A and 14B: 0.381
Sheet resistance of the conductive film 13: 2.0 [Ω/□ (ohm/square)]
Thickness of the conductive film 13: 0.01
Thickness of the conductor 50 and the electrodes 16A and 16B: 0.01

TABLE 1

| | Without 24A, B | With 24A, B |
|---|---|---|
| Examples 2-1 | 0.31 | 0.54 |
| Examples 2-2 | 0.37 | 0.49 |
| Examples 2-3 | 0.34 | 0.54 |

Table 1 shows the results of the numerical calculation of the fractional bandwidth at a VSWR (voltage standing wave ratio) of 3.0 or lower in a frequency range of 200 to 500 MHz. The fractional bandwidth of Table 1 is expressed by an arithmetic expression $$\text{fractional bandwidth}=F_W/[(F_H-F_L)/2] \quad (1)$$

$F_W$: the bandwidth at VSWR<3.0
$F_H$: the maximum value of the frequency at VSWR<3.0
$F_L$: the minimum value of the frequency at VSWR<3.0

As shown in Table 1, irrespective of the glass size, the value of the fractional bandwidth is increased by adding the independent slots 24A and 24B.

That is, by adding the independent slots, the bandwidth of the antenna can be widened.

EXAMPLE 3

In Example 3, a change of the antenna gain according to the difference in the position of installation in the vertical direction of the entire antenna of the present invention will be described.

FIG. 10 is a front view (viewed from the vehicle-interior side) of a laminated glass where the antenna of the mode of FIG. 3B is formed. FIG. 10 shows a condition where the laminated glass is attached to a vehicle body opening.

In Example 3, with respect to a planar antenna of the mode of FIG. 10 actually produced by using a laminated glass for the windscreen of a vehicle, the antenna gain when the distance L7 between the roof side vehicle body open end 41 and the upper edge 13*a* of the conductive film 13 was changed was measured by using a real vehicle.

The antenna gain was actually measured while the vehicle window glass where the glass antenna was formed was fitted to a window frame of the vehicle on a turntable. The antenna part of the vehicle window glass was inclined approximately 16 degrees with respect to the horizontal plane. To the feeding part (the feeding structure of FIG. 8 is adopted), the connector connected to the coaxial cable was attached.

The measurement of the antenna gain was performed while the vehicular center of the vehicle to which the vehicle window glass where the glass antenna was formed was fitted was set at the center of the turntable and the vehicle was being rotated 360 degrees. The data of the antenna gain was measured every 5 MHz at 250 to 450 MHz every rotation angle of 1 degree for two cases of the horizontally polarized wave and the vertically polarized wave. The measurement was performed with the elevation angle between the radio wave emission position and the slot 23 being the horizontal direction (the direction of an elevation angle of zero degrees when the elevation angle of the surface parallel to the ground was zero degrees and the elevation angle of the zenith direction was 90 degrees). The antenna gain was standardized, with reference to a half-wave dipole antenna, so that the half-wave dipole antenna was 0 dB.

The layer structure of FIG. 10 was that of the mode of FIG. 4B. The dimensions and constants of the parts in Example 2 were the same as those of Example 2 except for the outer dimensions of the laminated glass.

TABLE 2

| L7 | Horizontally polarized wave | Vertically polarized wave |
|---|---|---|
| 5 | −13.54 | −13.72 |
| 15 | −13.13 | −13.43 |
| 35 | −13.30 | −13.44 |

Table 2 shows the arithmetic mean values (unit: dBd) of the actually measured data of the antenna gain of all around 360 degrees at a representative frequency 330 MHz when the distance L7 was changed. As shown in Table 2, even though the distance L7 is changed, the antenna gain is not significantly changed. That is, the upper edge 13*a* of the conductive film 13 can be brought close to the vehicle body open end 41 and as a consequence thereof, the slot 23 can be brought close to the upper edge 12*a* of the window glass, so that the view through the window glass is improved.

EXAMPLE 4

In Example 4, a change of the antenna gain according to the difference in the position of installation in the horizontal direction of the entire antenna of the present invention will be described.

In Example 4, with respect to the flat panel antenna of the mode of FIG. 10 which was the same as that of Example 3, the antenna gain when the distance L5 between the A pillar side left edge 13*d* of the conductive film 13 and the center line of the slot 23 was changed was measured by using a real vehicle. The distance L7 was 15 mm, and the dimensions and constants of the other parts, and the antenna gain measurement condition were the same as those of Example 3.

Figure 11:
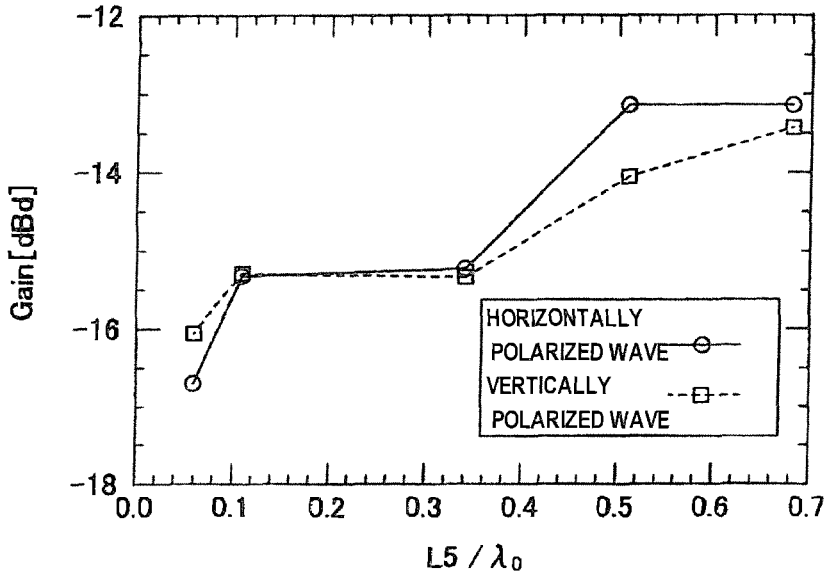
FIG. 11 shows the mean antenna gain when a distance L5 was changed.

FIG. 11 shows the arithmetic mean values (unit: dBd) of the actually measured data of the antenna gain of all around 360 degrees at a frequency of 330 MHz when the distance L5 standardized by a wavelength $\lambda_0$ of a representative frequency 330 MHz was changed. As shown in FIG. 11, it is advantageous in improving the antenna gain that the length to the center line between the left edge 13*d* and the right edge 13*b* of the conductive film 13 is the maximum value and that the distance L5 is not less than $0.1\lambda_0$, more preferably, not less than $0.4\lambda_0$.

EXAMPLE 5

In Example 5, a change of the antenna gain according to the difference in the position in the vertical direction of the electrodes 16 (16A and 16B) of the antenna of the present invention will be described.

In Example 5, with respect to the planar antenna of the mode of FIG. 10 which was the same as that of Example 3, the antenna gain when the distance L7 was 15 mm and the terminal positions Ly of the electrodes 16 were changed in the vertical direction was measured by using a real vehicle. The dimensions and constants of the parts, and the antenna gain measurement condition in Example 5 were the same as those of Example 3.

The terminal position Ly is expressed, using the reference designations of FIG. 3B, by an arithmetic expression $$Ly=(H11+H44(\text{or } H42))/H1 \quad (2)$$

H11+H44 (or H42): the distance between the lower end of the slot 23 and the upper end of the electrodes 16

H1: the length of the slot 23 (antenna length)

Figure 12:
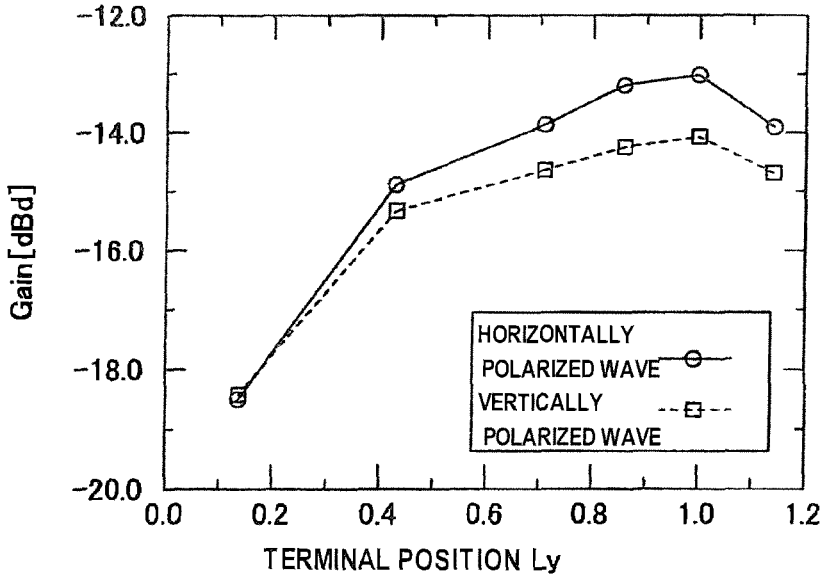
FIG. 12 shows the mean antenna gain when a terminal position Ly was changed.

FIG. 12 shows the arithmetic mean values (unit: dBd) of the actually measured data of the antenna gain of all around 360 degrees at a representative frequency of 330 MHz when the terminal position Ly was changed. As shown in FIG. 12, it is advantageous in improving the antenna gain that the terminal position Ly is not less than 0.4 and not more than 1.2, more preferably, not less than 0.5 and not more than 1.1. That is, the closer to the upper edge 13*a* of the conductive film 13 the electrodes 16A and 16B are, the more advantageous in improving the antenna gain.

EXAMPLE 6

In Example 6, a change of the antenna gain according to the difference in the position in the horizontal direction of the electrodes 16 (16A and 16B) of the antenna of the present invention will be described.

In Example 6, assuming the antenna of the mode of FIG. 3B in which the conductive film 13 was provided in an inner layer of a square laminated glass, the numerical calculation based on the FDTD method was performed every 0.6 MHz at frequencies of 250 to 450 MHz. Moreover, with the shortest distance W40 (see FIG. 3B) between the electrodes 16A and 16B being fixed to 10 mm, the numerical calculation was performed under the assumption that the electrodes 16 (16A, 16B) move rightward as a whole as shown in FIG. 13. In this numerical calculation, modeling was performed while a vehicle body frame which was the part to which the laminated glass where the antenna was formed was attached was regarded as being absent, and the boundary condition of the periphery of the glass was infinite (the periphery was free space).

The shape of the laminated glass assumed in Example 6 was a square that was 300 mm in height and width. The position of the center line of the slot 23 was on the bisector of one side of the square laminated glass. The layer structure assumed in Example 6 was the layer structure of the laminated glass and the feeding structure of FIG. 8. The dimensions (unit: mm) and constants of the parts in Example 6 were shown below using the reference designations of FIGS. 3A and 3B.

Thickness of the dielectric substrate 48: 0.4
Dielectric constant of the dielectric substrate 48: 4.0
Thickness of the acrylic foam tape 47: 0.4
Dielectric constant of the acrylic foam tape 47: 3.0
Thickness of the electrode 49A: 0.01
H1: 70
H21: 300
H23: 30
H24: 10
W5: 3
W21: 300
W23, W24: 10
W40: 10
W41, 542, W43, H44: 20

Figure 14:
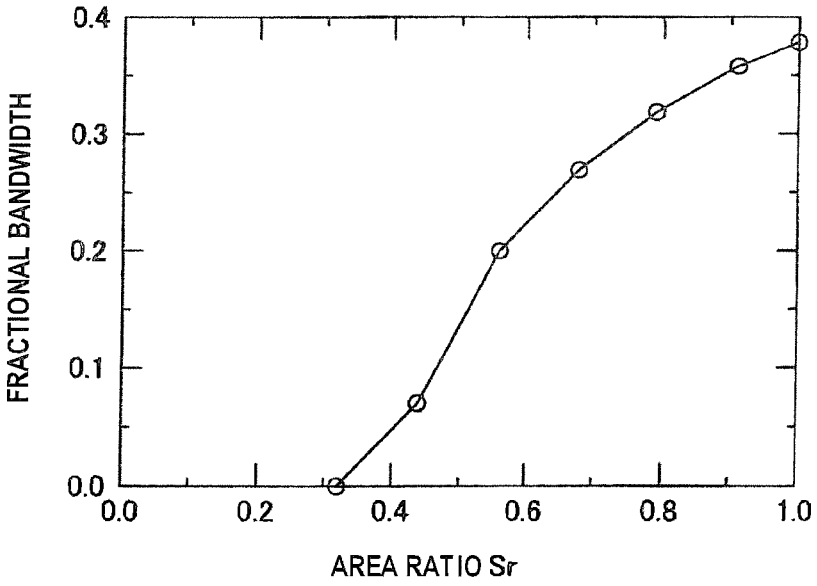
FIG. 14 shows the fractional bandwidth when an area ratio Sr was changed.

FIG. 14 shows the results of the numerical calculation of the fractional bandwidth at a VSWR of 3.0 or lower in a frequency range of 250 to 450 MHz when the area ratio Sr was changed. As shown in FIG. 13, when the left side region of the electrode 16A with respect to the slot 23 is 16Al and the right side region of the electrode 16A with respect to the slot 23 is 16Ar (the area overlapping the slot 23 is not included), the area ratio Sr along the horizontal axis of FIG. 14 is expressed by an arithmetic expression $$Sr = \text{the area of the region } 16Al / (\text{the area of the region } 16Al + \text{the area of the region } 16Ar) \quad (3)$$

The fractional bandwidth along the vertical axis of FIG. 14 is a value calculated according to the above arithmetic expression (1). As shown in FIG. 14, it is advantageous in widening the antenna bandwidth that the area ratio Sr is not less than 0.5, more preferably, not less than 0.6. That is, it is advantageous in widening the antenna bandwidth that the electrodes 16A and 16B are disposed on both sides of the slot 23 so as not to overlap the slog 23.

example 7

In Example 7, a change of the antenna gain according to the difference in the size (area) of the electrodes 16 (16A, 16B) of the antenna of the present invention will be described.

In Example 7, assuming the antenna of the mode of FIG. 3B which was the same as that of Example 6, the numerical calculation based on the FDTD method was performed every 0.6 MHz at frequencies of 250 to 450 MHz. In addition, with the shapes of the electrodes 16 being maintained square, the numerical calculation based on the FDTD method was performed for two cases where the width W5 of the slot 23 was 3.0 mm and where it was 7.5 mm. The dimensions and constants of the parts in Example 7 were the same as those of Example 6.

Figure 15:
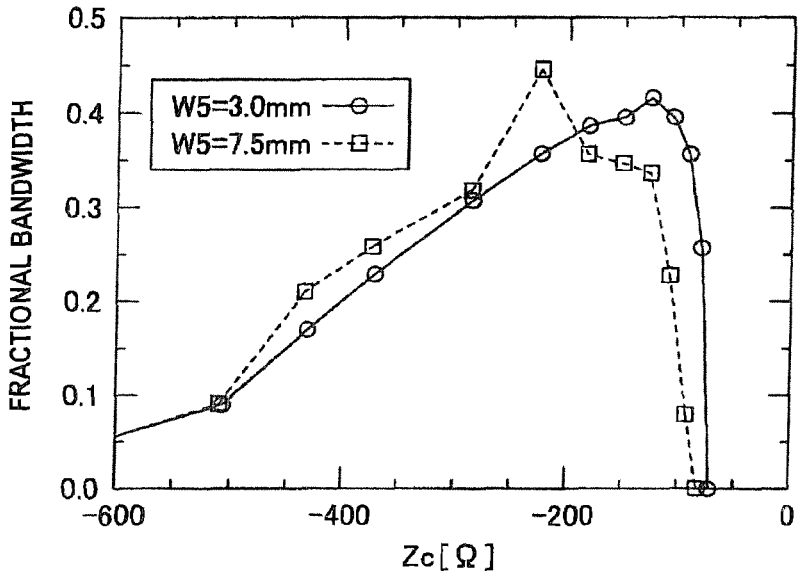
FIG. 15 shows the fractional bandwidth when an impedance Zc that changes according to the area of the electrodes 16 was changed.

FIG. 15 shows the results of the numerical calculation of the fractional bandwidth at a VSWR of 3.0 or lower in a frequency range of 250 to 450 MHz when the impedance Zc that changes according to the area of the electrodes 16 was changed. When the capacitance of the electrodes 16 proportional to the area of the electrodes 16 is C, the impedance Zc ($=-\frac{1}{2\pi FcC}$) along the horizontal axis of FIG. 15 is the calculation value at the denominator of the arithmetic expression (1) (that is, when W5=3.0 mm, the center frequency Fc=337 MHz and when W5=7.5 mm, the center frequency Fc=355 MHz). The fractional bandwidth along the vertical axis of FIG. 15 is a value calculated according to the above arithmetic expression (1). As shown in FIG. 15, it is advantageous in widening the antenna bandwidth that $-400 \leq Zc \leq -80$, more preferably, that $-300 \leq Zc \leq -100$.

EXAMPLE 8

In Example 8, a change of the antenna gain according to the difference in the size (area) of the electrodes 16 (16A, 16B) of the antenna of the present invention will be described.

In Example 8, with respect to the flat panel antenna of the mode of FIG. 10 which was the same as that of Example 3, the antenna gain when the length W41 of one side of the square electrodes 16 and the shortest distance W40 between the electrodes 16A and 16B were changed while the antenna length H1 of the slot 23 was fixed to 70 mm and the shapes of the electrodes 16 were maintained square was measured by using a real vehicle. The dimensions and constants of the parts, and the antenna gain measurement condition in Example 8 were the same as those of Example 3. When the antenna gain in Example 8 was measured, the feeding structure of FIG. 8 was actually produced.

TABLE 3

| | W41 = 16 | W41 = 20 | W41 = 24 |
|---|---|---|---|
| W40 = 5 | −15.11 | −13.97 | −13.54 |
| W40 = 10 | −15.13 | −14.35 | −14.15 |

TABLE 4

| | W41 = 16 | W41 = 20 | W41 = 24 |
|---|---|---|---|
| W40 = 5 | −14.73 | −13.86 | −13.54 |
| W40 = 10 | −14.88 | −14.30 | −14.15 |

TABLE 5

| | W41 = 16 | W41 = 20 | W41 = 24 |
|---|---|---|---|
| Zc[Ω] | −290.47 | −185.90 | −129.10 |

Table 3 shows the arithmetic mean values (unit: dBd) of the actually measured data of the antenna gain of all around 360 degrees at a representative frequency of 330 MHz when the shortest distance W40 and the length W41 of one side were changed in the case of the horizontally polarized wave. Table 4 shows the arithmetic mean values (unit: dBd) of the actually measured data of the antenna gain of all around 360 degrees at 330 MHz when the shortest distance W40 and the length W41 of one side were changed in the case of the vertically polarized wave. Table 5 shows Zc when the length W41 of one side is 16, 20 and 24 mm. As shown in Tables 3, 4 and 5, when the area of the electrodes 16 is changed, Zc is changed, and it is advantageous in improving the antenna gain that Zc is adjusted to a value close to the peak value of the graph shown in FIG. 15.

EXAMPLE 9

In Example 9, a change of the antenna gain according to the difference in the antenna length H1 of the antenna of the present invention will be described.

In Example 9, with respect to the planar antenna of the mode of FIG. 3B actually produced by using a square laminated glass, the antenna gain when the antenna length H1 of the slot 23 was changed was measured. The dimensions and constants of the parts in Example 9 were the same as those of Example 6. The antenna gain measurement condition was the same as that of Example 3 except that when the measurement was performed, the square laminated glass where the antenna of the mode of FIG. 3B was formed was vertically placed on a styrofoam platform.

Figure 16:
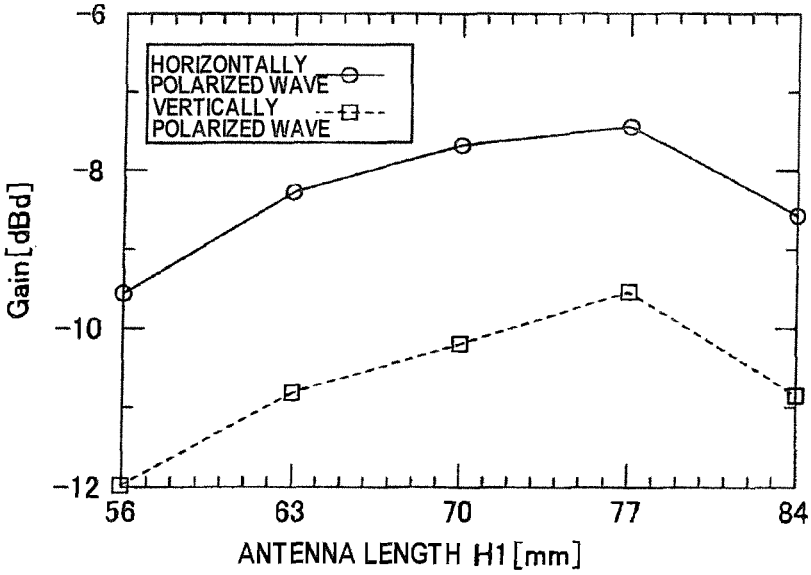
FIG. 16 shows the mean antenna gain when an antenna length H1 was changed.

FIG. 16 shows the arithmetic mean values (unit: dBd) of the actually measured data of the antenna gain of all around 360 degrees at a representative frequency of 380 MHz when the antenna length H1 was changed. As shown in FIG. 16, it is advantageous in improving the antenna gain that the antenna length H1 is not less than 63 mm and not more than 84 mm, more preferably, not less than 67 mm and not more than 80 mm.

EXAMPLE 10

In Example 10, a change of the antenna gain according to the difference in the antenna width W5 of the antenna of the present invention will be described.

In Example 10, with respect to the planar antenna of the mode of FIG. 3B which is the same as that of Example 9, the antenna gain when the antenna width W5 of the slot 23 was changed was measured. The dimensions and constants of the parts in Example 10 were the same as those of Example 6. The antenna gain measurement condition was the same as that of Example 9.

Figure 17:
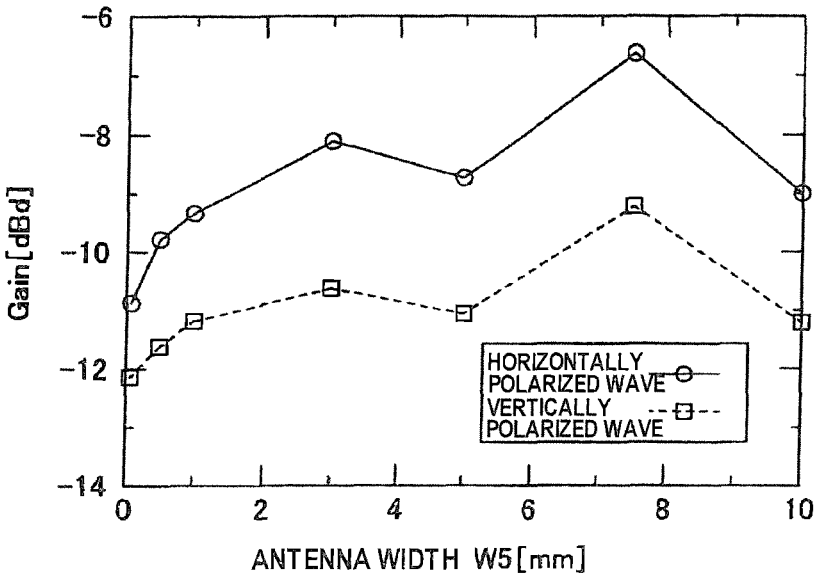
FIG. 17 shows the mean antenna gain when an antenna width W5 was changed.

FIG. 17 shows the arithmetic mean values (unit: dBd) of the actually measured data of the antenna gain of all around 360 degrees at a representative frequency of 380 MHz when the antenna width W5 was changed. As shown in FIG. 17, it is advantageous in improving the antenna gain that the antenna width W5 is not less than 1 mm and not more than 10 mm, more preferably, not less than 2 mm and not more than 9 mm.

EXAMPLE 11

In Example 11, a change of the antenna gain according to the difference in the shape of the slot 23 of the antenna of the present invention will be described.

Figure 18A:
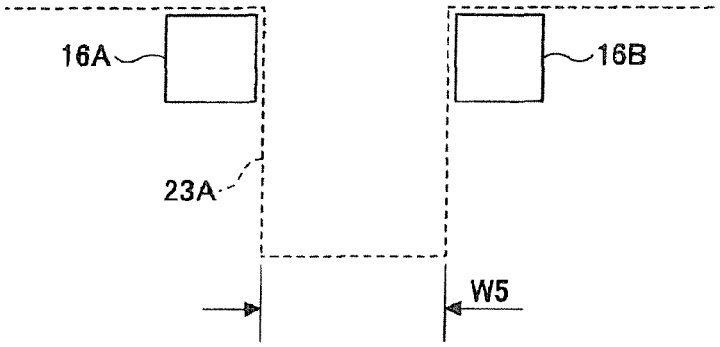
FIG. 18A shows a structure the same as that of the mode of FIG. 3B in which the slot width of the slot 23A is exaggerated.
Figure 18B:
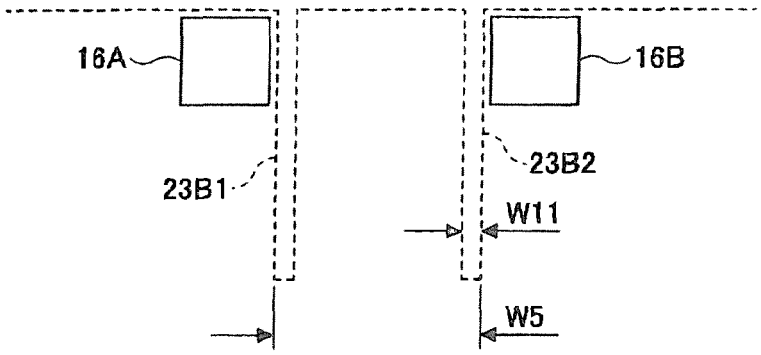
FIG. 18B shows a structure in which two thin-line slots 23B1 and 23B2 are disposed with a pitch the same as the antenna width W5 of FIG. 18A.
Figure 18C:
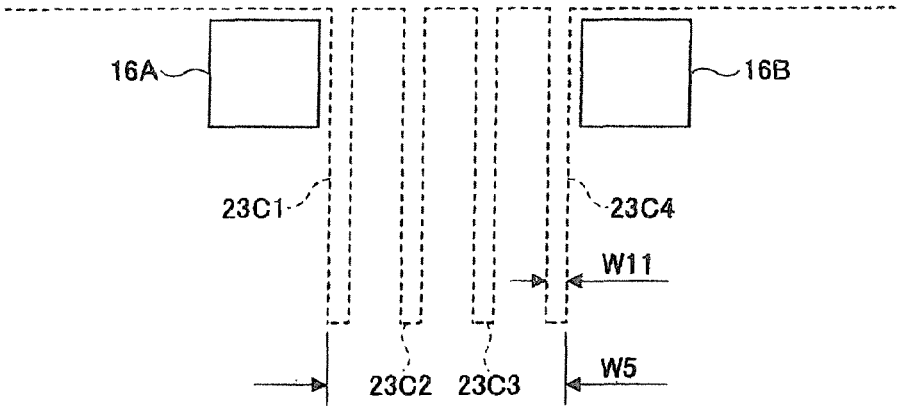
FIG. 18C shows a structure in which four thin-line slots 23C1 to 23C4 are evenly spaced in the antenna width W5 of FIG. 18A.
Figure 18D:
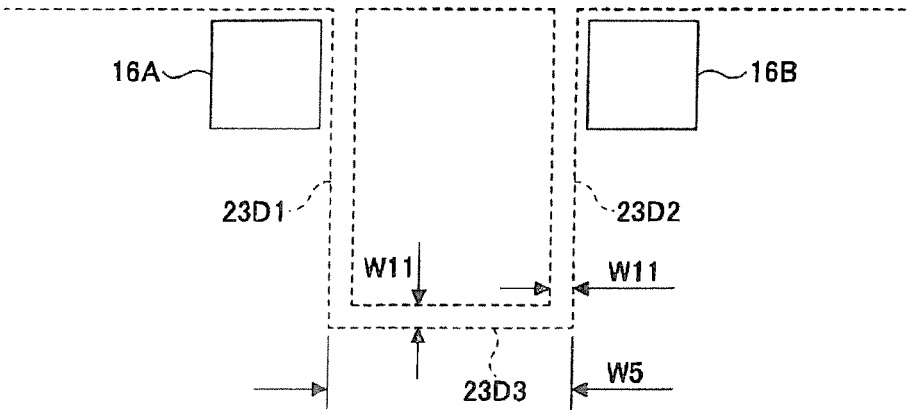
FIG. 18D shows a structure in which a thin-line slot 23D1 and a thin-line slot 23D2 are connected through a through slot 23D3.

In Example 11, the antenna gain of a planar antenna of the mode of FIGS. 18A to 18D actually produced by using a square laminated glass was measured. Variations of the slot 23 formed of a plurality of thin-line slots are shown. In each of FIGS. 18B to 18D, the slot width of the plurality of thin-line slots is represented as W11. FIG. 18A shows a slot structure the same as that of the mode of FIG. 3B in which the antenna width W5 of the slot 23A is exaggerated. FIG. 18B shows a slot structure in which two thin-line slots 23B1 and 23B2 are disposed with a pitch the same as the antenna width W5 of FIG. 18A. FIG. 18C shows a slot structure in which four thin-line slots 23C1 to 23C4 are evenly spaced in the antenna width W5 of FIG. 18A. FIG. 18D shows a U-shaped slot structure in which a thin-line slot 23D1 and a thin-line slot 23D2 are connected through a penetrating through slot 23D3. The dimensions and constants of the parts in Example 11 were the same as those of Example 6 except for the antenna width W5. The antenna gain measurement condition was the same as that of Example 9.

TABLE 6

| W11 | Number | Horizontally polarized wave | Vertically polarized wave |
|---|---|---|---|
| 0.08 | 2 | −1.00 | −0.30 |
| 0.08 | 4 | −0.67 | −0.41 |
| 0.08 | 10 | −0.70 | −0.28 |
| 0.50 | 2 | 0.15 | 0.23 |
| 0.50 | 5 | −0.34 | −0.24 |
| 0.50 | U shape (FIG. 18D) | −0.35 | −0.03 |

Table 6 shows the arithmetic mean values (unit: dB) of the actually measured data of the antenna gain of all around 360 degrees at a representative frequency of 380 MHz when the width W11 and the number of thin-line slots were changed, as the relative difference from the arithmetic mean values in the case of FIG. 18A. As shown in Table 6, the thin-line slot width W11 can be reduced while the antenna gain is ensured. Consequently, by providing a plurality of thin-line slots having a small width W11 in order to obtain the antenna width W5 necessary to improve the antenna gain shown in Example 10 (FIG. 17), similar characteristics can be obtained. By using thin thin-line slots, the slots can be made more inconspicuous to the passenger than when a thin slot 23 is provided and this improves the design, and since the thin-line slots can be easily formed by laser processing, productivity improves.

While the present application has been described in detail with reference to specific embodiments, it is obvious to one of ordinary skill in the art that various changes and modifications may be added without departing from the spirit and scope of the invention. The present application is based on Japanese Patent Application (Patent Application No. 2009-163099) filed on Jul. 9, 2009, the contents of which are incorporated herein by reference.

INDUSTRIAL APPLICABILITY

The present invention is suitable for use as a vehicle glass antenna that receives, for example, terrestrial digital television broadcasts, analog television broadcasts in the UHF band, and digital television broadcasts in the United States, digital television broadcasts in the European Union region or digital television broadcasts in the People's Republic of China. In addition, the present invention may also be used for the FM broadcast band in Japan (76 to 90 MHz), the FM broadcast band in the United States (88 to 108 MHz), the television VHF band (90 to 108 MHz, 170 to 222 MHz), and the vehicle keyless entry system (300 to 450 MHz).

Moreover, the present invention may be used for the 800-MHz band for automobile telephone (810 to 960 MHz), the 1.5-GHz band for automobile telephone (1.429 to 1.501 GHz), GPS (Global Positioning System), the GPS signal of artificial satellites 1575.42 MHz), VICS (trademark) (Vehicle Information and Communication System: 2.5 GHz).

Further, the present invention may be used for ETC communications (Electronic Toll Collection System: the non-stop automatic fare collection system, the transmission frequency of roadside radio units: 5.795 GHz or 5.805 GHz, the reception frequency of roadside radio units: 5.835 GHz or 5.845 GHz), Dedicated Short Range Communication (DSRC, 915-MHz band, 5.8-GHz band, 60-GHz band), and communications of microwaves (1 GHz to 3 THz), millimeter waves (30 to 300 GHz) and SDARS (Satellite Digital Audio Radio Service (2.34 GHz, 2.6 GHz)).

EXPLANATION OF REFERENCE NUMERALS

1, 2 Glass plate
3 Conductive film
4 Intermediate film
5 Antenna conductor
6 Electrode
7 Conductor
11 Vehicle-exterior side glass plate
12 Vehicle-interior side glass plate
12*a* to 12*d* Outer edge
13 Heat reflecting film (conductive film)
13*a* to 13*d* Outer edge
14 Intermediate film
16A, 16B Electrode
18 Shielding film
20 Antenna
21 First coupled part
22 Second coupled part
23 Slot
24, 24A, 24B Independent slot
32 Dielectric substrate
38, 38A, 38B Bonding agent (bonding layer)
41 Roof side vehicle body open end
42, 44 Pillar side vehicle body open end
43 Chassis side vehicle body open end
45 Vehicle body frame
46 Bonding agent

47 Acrylic foam tape
48 Dielectric substrate
48*a* Through hole
49 Electrode
49A Upper electrode
49B Lower electrode
50 Conductor

The invention claimed is:

1. A vehicle window glass comprising:
a glass plate;
a conductive film laminated on the glass plate; and
an antenna structured with a feeding structure placed on the conductive film, wherein the feeding structure has a dielectric and a pair of electrodes;
one electrode of the pair of electrodes is connected with a signal line, and another electrode of the pair of electrodes is connected with a ground line;
the conductive film has a slot one end of which makes an end portion of the conductive film an open end, and is disposed between the glass plate and the dielectric; and
the pair of electrodes are disposed on an opposite side of a side of the conductive film with the dielectric in between so that the slot is sandwiched between the pair of electrodes when the pair of electrodes are projected onto the conductive film, and are capacitively coupled to the conductive film.

2. The vehicle window glass according to claim 1, wherein the conductive film has an independent slot close to the slot.

3. The vehicle window glass according to claim 1, wherein the dielectric is another glass plate different from the glass plate.

4. The vehicle window glass according to claim 3, wherein an intermediate film is provided between the glass plate and the other glass plate.

5. The vehicle window glass according to claim 4, wherein an intermediate film is provided between the glass plate and the conductive film.

6. The vehicle window glass according to claim 3, wherein the conductive film is formed on a surface on a side facing a glass plate side of the other glass plate.

7. The vehicle window glass according to claim 4, wherein an intermediate film is provided between the other glass plate and the conductive film.

8. The vehicle window glass according to claim 1, wherein the dielectric is a resin substrate made of a resin.

9. The vehicle window glass according to claim 8, wherein a bonding layer for bonding the conductive film and the resin substrate together is provided.

10. The vehicle window glass according to claim 8, wherein a bonding layer for bonding the conductive film and the glass plate together is provided.

11. The vehicle window glass according to claim 1, wherein the conductive film is formed on the glass plate.

12. The vehicle window glass according to claim 1, wherein an outer edge of the conductive film is offset inward with respect to an outer edge of the glass plate.

13. The vehicle window glass according to claim 1, wherein a shielding film is disposed between the glass plate and the pair of electrodes.

14. The vehicle window glass according to claim 1, wherein the slot is provided more than one in number.

15. An antenna comprising:
a glass plate;
a conductive film laminated on the glass plate; and
a feeding structure provided on the conductive film, wherein:
the feeding structure has a dielectric and a pair of electrodes;
one electrode of the pair of electrodes is connected with a signal line, and another electrode of the pair of electrodes is connected with a ground line;
the conductive film has a slot one end of which makes an end portion of the conductive film an open end, and is disposed between the glass plate and the dielectric; and
the pair of electrodes are disposed on an opposite side of a side of the conductive film with the dielectric in between so that the slot is sandwiched between the pair of electrodes when the pair of electrodes are projected onto the conductive film, and are capacitively coupled to the conductive film.

* * * * *